US009960005B2

(12) United States Patent
Velásquez-García

(10) Patent No.: US 9,960,005 B2
(45) Date of Patent: May 1, 2018

(54) MICROPLASMA GENERATION DEVICES AND ASSOCIATED SYSTEMS AND METHODS

(71) Applicant: Massachusetts Institute of Technology, Cambridge, MA (US)

(72) Inventor: Luis Fernando Velásquez-García, Newton, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 66 days.

(21) Appl. No.: 14/420,052

(22) PCT Filed: Aug. 8, 2013

(86) PCT No.: PCT/US2013/054138

§ 371 (c)(1),
(2) Date: Feb. 6, 2015

(87) PCT Pub. No.: WO2014/026001

PCT Pub. Date: Feb. 13, 2014

(65) Prior Publication Data

US 2015/0213991 A1 Jul. 30, 2015

Related U.S. Application Data

(60) Provisional application No. 61/680,863, filed on Aug. 8, 2012.

(51) Int. Cl.
*H01J 17/04* (2012.01)
*H01J 11/18* (2012.01)
(Continued)

(52) U.S. Cl.
CPC ..... *H01J 17/04* (2013.01); *H01J 11/18* (2013.01); *H01J 17/20* (2013.01); *H05H 2001/481* (2013.01)

(58) Field of Classification Search
CPC .. H01J 11/12; H01J 11/18; H01J 11/62; H01J 17/04; H01J 17/20; H05H 1/24
(Continued)

(56) References Cited

U.S. PATENT DOCUMENTS 6,828,730 B2 12/2004 Eden et al.
8,198,106 B2 6/2012 Akinwande et al.
(Continued)

FOREIGN PATENT DOCUMENTS

WO WO 2013-016497 A2 1/2013

OTHER PUBLICATIONS

Baars-Hibbe et al., Micro-structured electrode arrays: high-frequency discharges at atmospheric pressure—characterization and new applications. Vaccum. Apr. 2004. 73 (3-4): 327-32. doi:10.1016/j.vacuum.2003.12.107.
(Continued)

*Primary Examiner* — Tung X Le
(74) *Attorney, Agent, or Firm* — Wolf, Greenfield & Sacks, P.C.

(57) ABSTRACT

Microplasma generators and associated arrays and methods are described herein. Certain embodiments relate to a microplasma generator in which an elongated semiconductor structure can control electronic current supplied to a microplasma cavity. In certain cases, the microplasma generator can be configured to generate a microplasma when a voltage is applied across the elongated semiconductor structure. Some embodiments include particular spatial arrangements between the electrode(s), the elongated semiconductor structure, and/or the microplasma cavity.

23 Claims, 9 Drawing Sheets

(51) Int. Cl.
*H01J 17/20* (2012.01)
*H05H 1/48* (2006.01)

(58) Field of Classification Search
USPC ..... 313/582, 585
See application file for complete search history.

(56) References Cited

U.S. PATENT DOCUMENTS

| | | | | |
|---|---|---|---|---|
| 8,952,612 | B1 * | 2/2015 | Pavliscak | H01J 11/12 313/582 |
| 2002/0164883 | A1 | 11/2002 | Ohmi et al. | |
| 2007/0236145 | A1 * | 10/2007 | Kang | H01J 11/16 313/582 |
| 2008/0129185 | A1 | 6/2008 | Eden et al. | |
| 2009/0246932 | A1 * | 10/2009 | Kamioka | H01L 21/76208 438/421 |
| 2010/0289413 | A1 | 11/2010 | Eden et al. | |
| 2011/0037102 | A1 | 2/2011 | Tchertchian et al. | |
| 2011/0126929 | A1 | 6/2011 | Velasquez-Garcia et al. | |
| 2011/0140073 | A1 | 6/2011 | Eden et al. | |
| 2011/0181169 | A1 * | 7/2011 | Eden | H05H 1/24 313/231.31 |
| 2012/0045863 | A1 | 2/2012 | Hopwood | |
| 2013/0113370 | A1 | 5/2013 | Tabib-Azar | |
| 2014/0027622 | A1 * | 1/2014 | Tanielian | H01J 31/50 250/214 LA |

OTHER PUBLICATIONS

Becker et al., Microplasmas: scientific challenges & technological opportunities. Eur. Phys. J. D. Sep. 14, 2010. 60(3): 437-9. Doi: 10.1140/epjd/e2010-00231-4.

Gamero-Castaño et al., Sputtering yields of Si, SiC, and B4C under nanodroplet bombardment at normal incidence. Journal of Applied Physics. 2009. 106: 054305. doi: 10.1063/1.3211304.

Gasdaska et al., Testing of Carbon Nanotube Field Emission Cathodes. 40th AIAA/ASME/SAE/ASEE Joint Propulsion Conference and Exhibit. Fort Lauderdale, Florida. Jul. 11-14, 2004. doi: 10.2514/6.2004-3427.

Gassend et al., A Microfabricated Planar Electrospray Array Ionic Liquid Ion Source With Integrated Extractor . J. of Microelectromech. Syst. Jun. 2009. 18(3): 679-94. DOI: 10.1109/JMEMS.2009.2015475.

Gatsonis et al., A three-dimensional electrostatic particle-in-cell methodology on unstructured Delaunay—Voronoi grids. Journal of Computational Physics. Jun. 1, 2009. 228 (10): 3742-3761. doi:10.1016/j.jcp.2009.02.003.

Gatsonis et al., Investigation of Rarefied Supersonic Flows Into Rectangular Nanochannels Using a Three-Dimensional Direct Simulation Monte Carlo Method. Physics of Fluids. Mar. 17, 2010. 22: 032001.

Hong et al., Temporal and spatial current stability of smart field emission arrays. IEEE Transactions on Electron Devices. Oct. 2005. 52(10): 2323-8. DOI:10.1109/TED.2005.856179.

Hudanksi et al., Carbon nanotube based photocathodes. Nanotechnology. Feb. 13, 2008. 19(10): 105201. 6 pages.

Liu et al., Low leakage current optically gated silicon field emitter arrays . J Vac Sci Technology B. Feb. 4, 2003. 21(1): 464-70.

Mariotti et al., Microplasmas for nanomaterials synthesis. J of Physical D. Appl. Phys. Aug. 18, 2010. 43(32): 323001.

Park et al., Arrays of microdischarge devices having 50-100 μm square pyramidal Si anodes and screen cathodes. Electronics Letters. Feb. 1, 2001. 37(3): 171-2. DOI:10.1049/el:20010086.

Patridge et al., Development of a micro-retarding potential analyzer for high-density flowing plasmas. IEPC-2005-170, Princeton, NJ. Oct. 2005. 1-114.

Patridge, Development and implementation of diagnostics for unsteady small-scale plasma plumes. Dissertation, WPI, Worchester, MA. Sep. 2008. Advisor: N. A. Gatsonis.

Rostler et al., Streamer Growth in an E-Beam Sustained Discharge. IEEE Trans on Plasma Science. Aug. 12, 2008. 36 (4): 938-9. DOI: 10.1109/TPS.2008.924417.

Shi et al., Parallel operation of microhollow cathode discharges. IEEE Trans. on Plasma Science. Feb. 1999. 27(1):16-17. DOI:10.1109/27.763000.

Shoenback et al., Microhollow cathode discharges. Appl Phys. Lett. 1996. 68(1):13-15.

Tachibana et al., Current Status of Microplasma Research. Trans. On Electrical and Electronic Engineering. Aug. 21, 2006. 1(2): 145-55. DOI: 10.1002/tee.20031.

Takemura et al., A novel vertical current limiter fabricated with a deep trench forming technology for highly reliable field emitter arrays. Tech Digest of the IEEE IEDM. Dec. 10, 1997. 709-12. DOI:10.1109/IEDM.1997.650481.

Vaudiane et al., 'Microtips' fluorescent display. Tech digest of IEEE IEDM. Dec. 8-11, 1991. 197-200. DOI:10.1109/IEDM.1991.235468.

Velásquez-García et al., A Planar Array of Micro-Fabricated Electrospray Emitters for Thruster Applications. J. of Microelectromech. Syst. Oct. 2006. 15 (5): 1272-80. DOI: 10.1109/JMEMS.2006.879710.

Velásquez-García et al., Uniform High Current Field Emission of Electrons from Si and CNF FEAs Individually Controlled by Si Pillar Ungated FETs. IEDM Tech Dig. Washington DC, Dec. 2007. 599-602. DOI:10.1109/IEDM.2007.4419010.

Velásquez-García et al., Uniform high-current cathodes using massive arrays of Si field emitters individually controlled by vertical Si ungated FETs—Part B: Device fabrication and characterization, IEEE Trans. Electron Devices. Jun. 2011. 58(6):1783-91.

Von Allmen et al., Ceramic microdischarge arrays with individually ballasted pixels. Applied Physics Letters. Apr. 21, 2003. 82 (16): 2562-4. doi: 10.1063/1.1565186.

Von Allmen et al., Linear, segmented microdischarge array with an active length of ~1 cm: cw and pulsed operation in the rare gases and evidence of gain on the 460.30 nm transition of Xe +.Appl Phys Lett. Jun. 23, 2003. 82(25): 4447-9. doi: 10.1063/1.1585137.

Wagner et al., Excitation of a microdischarge with a reverse-biased pn junction. Applied Physics Letters. Feb. 5, 2001. 78(6): 709-11.

Walsh et al., Characterisation of a 3 nanosecond pulsed atmospheric pressure argon microplasma. Topical issue: Microplasmas: Scientific Challenges and Technological opportunities. Eur Phys. J. D.. Dec. 2010. 60(3): 523-30. DOI: 10.1140/epjd/e2010-00238-9.

Wang et al., Simulation of a direct current microplasma discharge in helium at atmospheric Pressure. J. Appl. Phys. Jul. 2006. 100(2): 023301. doi: 10.1063/1.2214591.

International Preliminary Report on Patentability dated Feb. 19, 2015 for Application No. PCT/US2013/054138.

International Search Report and Written Opinion dated Feb. 4, 2014 for Application No. PCT/US2013/054138.

Velásquez-García et al., Uniform High-Current Cathodes Using Massive Arrays of Si Field Emitters Individually Controlled by Vertical Si Ungated FETs—Part 1: Device Design and Simulation. Electron Devices, IEEE Transactions on . Jun. 2011. 58(6):1775-82. doi: 10.1109/TED.2011.2128322.

Chen et al., Microdischarge device fabricated in silicon by micromachining technique with pyramidal cavity. Transducers '01 Eurosensors XV. The 11th International Conference on Solid-State Sensors and Actuators. Munich, Germany. Jun. 10-14, 2001: 674-677.

* cited by examiner

MICROPLASMA GENERATION DEVICES AND ASSOCIATED SYSTEMS AND METHODS

RELATED APPLICATIONS

This application is a national stage filing under 35 U.S.C. § 371 of International Application Number PCT/US2013/054138, filed Aug. 8, 2013, entitled "Microplasma Generation Devices and Associated Systems and Methods," by Velásquez-García, which claims priority under 35 U.S.C. § 119(e) to U.S. Provisional Patent Application Ser. No. 61/680,863, filed Aug. 8, 2012, and entitled "Arrays of Miniaturized Plasma Sources Individually Regulated by Vertical Structures," each of which is incorporated herein by reference in its entirety for all purposes.

TECHNICAL FIELD

Microplasma generators, and associated arrays and methods, are generally described.

BACKGROUND

Plasmas can be created by supplying energy to a neutral gas so that free electrons and ions are created. In a thermal plasma, electrons, ions, and neutral atoms and/or molecules (referred to as "neutrals") are in thermal equilibrium. However, in a non-thermal plasma, the electron temperature may be much higher than the temperature of ions and neutrals, and the energy distribution of the electrons may be highly non-Maxwellian (i.e., not following a Maxwell-Boltzmann distribution). In some cases, non-thermal plasmas could exist at high pressures. In such high-pressure plasmas, collision and radiative processes may be dominated by step-wise processes and three-body collisions that create excimers. These processes may be of importance to a wide range of applications, including high-power lasers, synthesis of nanomaterials, electromagnetic absorbers and reflectors, control of the boundary layer in airfoils, and biological decontamination. Unfortunately, previous systems have been unable to generate non-thermal, high-pressure plasmas in large volumes due to instabilities, which limits their practical utility. Systems and methods that could be used to generate stable, high-pressure plasmas in large volumes would therefore be desirable.

SUMMARY

Microplasma generators, arrays of microplasma generators, and methods of generating microplasma are generally described. The subject matter of the present invention involves, in some cases, interrelated products, alternative solutions to a particular problem, and/or a plurality of different uses of one or more systems and/or articles.

In certain embodiments, a microplasma generator is described. In some embodiments, the microplasma generator comprises an elongated semiconductor structure comprising a longitudinal axis; and a microplasma cavity spatially defined by a structure comprising the elongated semiconductor structure and an electrode, wherein the microplasma generator is configured to generate a microplasma when a voltage is applied across the elongated semiconductor structure along the longitudinal axis of the structure.

Some embodiments are directed to arrays of microplasma generators. In certain embodiments, the array of microplasma generators comprises a plurality of elongated semiconductor structures comprising longitudinal axes; and a plurality of microplasma cavities spatially defined by structures comprising the elongated semiconductor structures and electrodes, wherein the array is configured such that, when a voltage above a threshold value is applied to the array, microplasma is generated within the microplasma cavities, and the standard deviation in the electronic current levels supplied to each of the microplasma cavities is less than about 50% of the average of the electronic current levels supplied to the microplasma cavities.

In some embodiments, the array of microplasma generators comprises a plurality of elongated semiconductor structures comprising longitudinal axes; a plurality of microplasma cavities spatially defined by structures comprising the elongated semiconductor structures and first electrodes; and a plurality of gate electrodes adjacent to the elongated semiconductor structures and outside the microplasma cavities. In some embodiments, the array is configured such that, when a voltage above a threshold value is applied to the array, microplasma is generated within the microplasma cavities, and when a voltage is applied to the gate electrode, a saturation current of the elongated semiconductor structure is altered.

Certain embodiments are directed to methods of generating microplasma. In some embodiments, the method comprises applying a voltage along a longitudinal axis of an elongated semiconductor structure such that microplasma is generated within a microplasma cavity spatially defined by a structure comprising the elongated semiconductor structure and an electrode.

In some embodiments, the method comprises applying a voltage to at least two microplasma cavities each defined by a structure comprising an elongated semiconductor and an electrode, wherein the standard deviation in the electronic current levels supplied to each of the microplasma cavities is less than about 50% of the average of the electronic current levels supplied to the microplasma cavities.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1A:
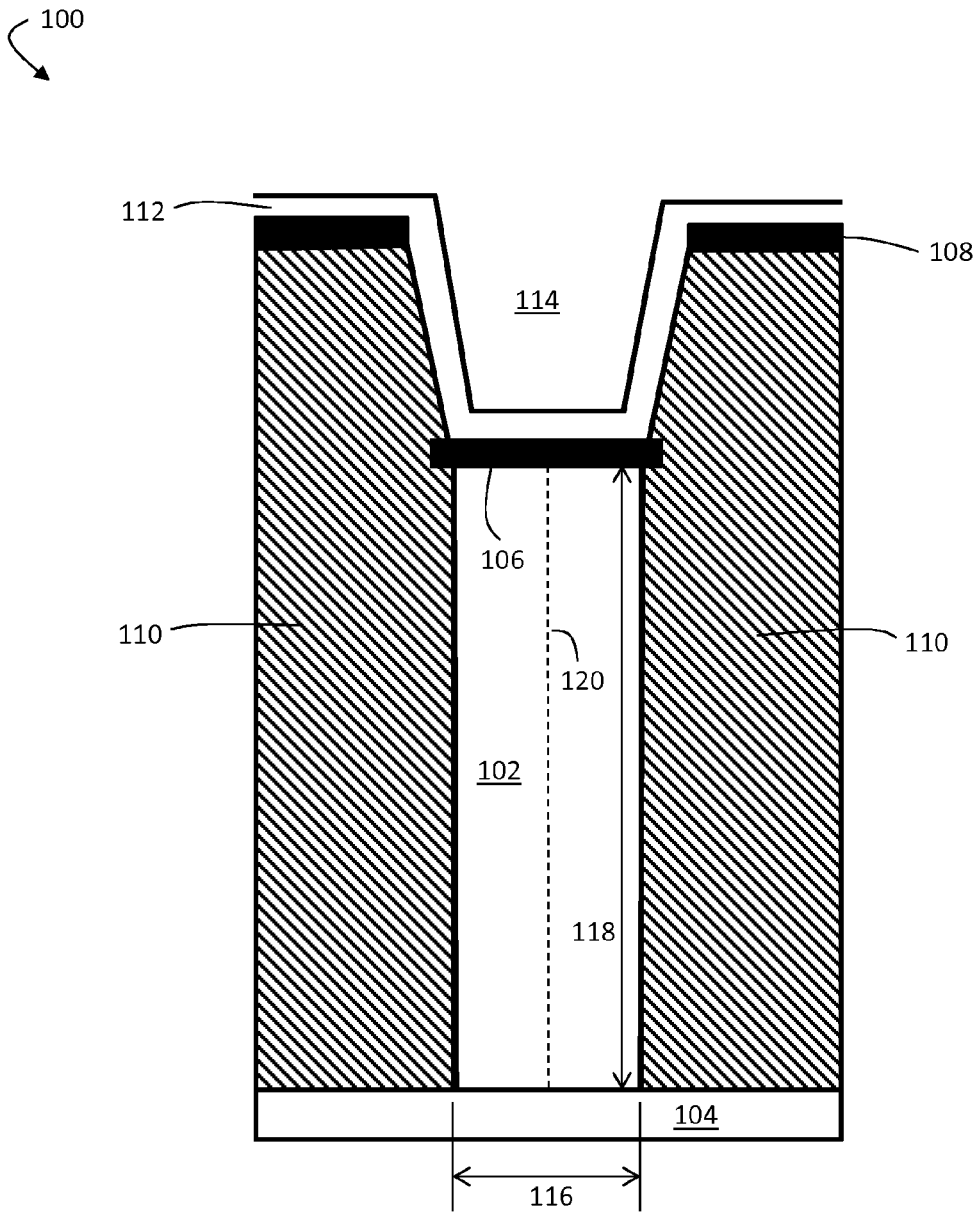
FIGS. 1A-1B are, according to one set of embodiments, exemplary cross-sectional, side view schematic illustrations of microplasma generators.

Microplasma generators and associated arrays and methods are described herein. Certain embodiments relate to a microplasma generator in which an elongated semiconductor structure can control electronic current supplied to a microplasma cavity. Controlling electronic current (also referred to herein as "ballasting") may be advantageous in certain, but not necessarily all, cases because it may allow for the delivery of relatively consistent levels of electronic current and/or power to a microplasma cavity or across an array of microplasma cavities, which may prevent instability, thereby allowing for stable generation of microplasmas. For example, ballasting may prevent ionization overheating thermal instability, as will be discussed in more detail below. In some (but not necessarily all) cases, it may be advantageous to control electronic current through an elongated semiconductor structure. Many alternative ballasting structures, such as resistors, reduce variations in the delivered electronic current at the expense of current level. Such ballasting schemes can result in the delivery of relatively low levels of electronic current, which can be unsuitable for many applications. On the other hand, elongated semiconductor structures may provide the desired ballasting effect with high dynamic resistance while also delivering relatively high electronic current levels.

Some embodiments relate to arrays of microplasma generators configured to generate microplasmas with relatively consistent properties, from generator to generator. Such arrays may allow for stable generation of microplasmas with large cumulative volumes and/or microplasmas covering relatively large areas. Certain of such large volume and/or large area microplasma arrays may exhibit characteristics that make them suitable for a number of applications. For example, due to the relatively small size of each individual microplasma volume that is generated according to certain embodiments, the microplasmas may be generated at relatively high pressures. The components of high-pressure microplasmas may undergo collision and radiative processes that create excimers, which may be useful for high-power lasers, nanomaterial synthesis, and/or biological decontamination.

Some embodiments relate to microplasma generators and associated methods that can be used to generate plasma in regimes that would be inherently unstable in other systems and/or using other methods.

Certain embodiments relate to the use of gate electrodes to control the amount of current supplied to the microplasma generators.

Microplasmas are generally gases comprising electrons and/or ions that occupy a volume of less than about 1 cubic millimeter. In some embodiments, the microplasma may also contain neutral atoms and/or molecules (which can also be referred to as "neutrals"). In certain embodiments, the microplasma has a Debye length on the order of about 1 cm or less. Those of ordinary skill in the art understand Debye length to refer to a distance within which a charge carrier, such as an ion or electron, has an electrostatic effect on another charge carrier. Debye length $\lambda_D$ can be expressed mathematically as:

$$\lambda_D = \sqrt{\frac{\frac{\epsilon_0 k_B}{q_e^2}}{\frac{n_e}{T_e} + \Sigma_{ij}\frac{j^2 n_{ij}}{T_i}}}$$

where $\in_O$ is the permittivity of free space, $k_B$ is the Boltzmann constant, $q_e$ is the charge of an electron, $T_e$ is the temperature of the electrons, $T_i$ is the temperature of the ions, $n_e$ is the density of electrons, and $n_{ij}$ is the density of ions i with net charge j. The permittivity of free space is a constant having a value of about $8.85\times10^{-12}$ Farads per meter. The Boltzmann constant is a constant having a value of about $1.38\times10^{-23}$ Joules per Kelvin. The charge of an electron is a constant having a value of about $1.6\times10^{-19}$ coulombs. Electron temperature $T_e$, ion temperature $T_i$, electron density $n_e$, and ion density $n_{ij}$ are properties of the microplasma that can be measured by a variety of methods that include, but are not limited to, Langmuir probes and optical spectroscopy.

FIG. 1A is an exemplary schematic illustration of a microplasma generator, according to certain embodiments. As illustrated in FIG. 1A, microplasma generator 100 comprises semiconductor structure 102. In certain embodiments, a microplasma cavity may be spatially defined by a structure comprising the elongated semiconductor structure and an electrode. For example, in FIG. 1A, microplasma generator 100 includes microplasma cavity 114 spatially defined by semiconductor structure 102 and electrode 108. The microplasma cavity may be configured such that microplasma is generated within the microplasma cavity when an electrical current is applied to the microplasma generator.

In the exemplary embodiment of FIG. 1A, semiconductor structure 102 is in electronic communication with substrate 104, which is positioned at a first end of semiconductor structure 102. Generally, if two structures are in electronic communication, electronic current can flow between the two structures. In certain embodiments, semiconductor structure 102 is in contact (e.g., indirect contact or direct contact) with substrate 104. Semiconductor structure 102 may also be in contact (indirectly or directly) with optional second electrode 106. Optional second electrode can be positioned at a second end of semiconductor structure 102 (which can be, in certain embodiments, opposite the end of the semiconductor structure 102 that is in contact with substrate 104). In certain embodiments, semiconductor structure 102 is at least partially (and, in some instances, substantially completely) surrounded by insulating structures 110. In some embodiments, as described in more detail below, protective layer 112 lines at least a portion of (and, in certain cases, substantially all of) the interior of microplasma cavity 114.

Semiconductor structure 102 can be formed of any suitable semiconductor material or combination of semiconductor materials. Those of ordinary skill in the art are generally familiar with semiconductors, which are materials that have bulk resistivities greater than the bulk resistivities of electrical conductors and lower than the bulk resistivities of electrical insulators. For example, in certain embodiments, the semiconductor structures described herein have a bulk resistivity of at least about 5 milliohm-cm, at least about 100 milliohm-cm, at least about 1 ohm-cm, at least about 10 ohm-cm (and/or, in certain embodiments, up to about 10,000 ohm-cm, or more). The bulk resistivity of a semiconductor structure can be controlled, for example, by selecting a material or materials from which the semiconductor structure is formed having a desired bulk resistivity, by adjusting the concentration of one or more dopant atoms within the semiconductor structure to achieve a desired bulk resistivity, and/or by any other suitable method. The bulk resistivity of a semiconductor material may be determined, for example, by performing a four-point probe measurement.

In certain embodiments, the elongated semiconductor structure comprises one or more inorganic semiconductors. In some embodiments, the elongated semiconductor structure comprises one or more organic semiconductors. Examples of suitable semiconductors that may be used, alone or in combination, to fabricate the elongated semiconductor structure include, but are not limited to, Group IV elements (including, e.g., silicon, carbon, and germanium); binary compounds comprising elements from Groups III and V, Groups II and VI, and between different Group IV elements (including, e.g., gallium arsenide and gallium nitride); organic semiconductor compounds; and the like. In some embodiments, the elongated semiconductor structure may comprise at least one of silicon, silicon carbide, gallium arsenide, gallium nitride, and germanium. In some embodiments, the elongated semiconductor structure may comprise at least one of silicon, silicon carbide, gallium nitride, and germanium. In certain embodiments, the elongated semiconductor structure comprises silicon.

For example, silicon carbide may be selected as the material from which the elongated semiconductor structure is formed, in some embodiments, including certain embodiments in which the microplasma generator is configured for use in high-temperature and/or high-radiation applications. Gallium nitride may be used to form all or part of the elongated semiconductor structure, in certain embodiments, including some embodiments in which the microplasma generator is configured for use in high-bandwidth and/or high-temperature applications. Germanium may be used in certain embodiments, including some embodiments in which the microplasma generators are configured for use in devices that can be modulated using communications-rated lasers (e.g., lasers with a wavelength in the range of about 1000 to about 2000 nm).

In some embodiments, the semiconductor structures may be elongated. Generally, the elongated semiconductor structures comprise a longitudinal axis, which runs parallel to the elongated dimension of the elongated nanostructure (i.e., the length of the nanostructure) and intersects the geometric center of the elongated nanostructure. Each semiconductor structure can also have a width, which generally refers to the dimension spanning two outer boundaries of the semiconductor structure, as measured perpendicular to the longitudinal axis of the elongated nanostructure. For example, referring to the exemplary embodiment of FIG. 1A, semiconductor structure 102 has a width 116, which is perpendicular to longitudinal axis 120. In cases where the width varies along the longitudinal axis, the width corresponds to the average width along the longitudinal axis.

In some embodiments, the width of the elongated semiconductor structure may be at least about 10 microns, at least about 20 microns, at least about 50 microns, at least about 100 microns, at least about 200 microns, at least about 500 microns, or at least about 750 microns (and/or, in certain embodiments, up to about 1 mm, or more). In some embodiments, the width of the semiconductor structure may range from about 10 microns to about 1 mm.

In some embodiments, each semiconductor structure has a length. The length of the elongated semiconductor nanostructure generally refers to the dimension across opposed boundaries of the semiconductor structure that is measured parallel to the longitudinal axis (and, hence, perpendicular to its width). That is to say, the length of a structure is generally measured along its elongated dimension. For example, in FIG. 1A, semiconductor structure 102 has a length 118. In certain embodiments, the length of the semiconductor nanostructure may correspond to the height of the semiconductor nanostructure. For example, as illustrated in FIG. 1A, semiconductor structure 102 is illustrated as being oriented such that its longitudinal axis points up and away from the substrate. Thus, in the exemplary embodiment of FIG. 1A, the length of semiconductor structure 102 corresponds to the height of the semiconductor nanostructure. In some embodiments, the length of the elongated semiconductor structure is non-parallel relative to the substrate over which it is positioned. In certain embodiments, the length of the elongated semiconductor structure is within about 15°, within about 10°, within about 5°, or within about 1° of perpendicular to the substrate over which it is positioned.

The length of the semiconductor nanostructure may, in some embodiments, be greater than the width of the semiconductor structure. In some embodiments, the length of the semiconductor structure may be at least about 100 microns, at least about 200 microns, at least about 500 microns, at least about 1 mm, at least about 5 mm, at least about 10 mm, at least 50 mm, or at least about 100 mm (and/or, in certain embodiments, up to about 500 mm, or more). In some embodiments, the height of the semiconductor structure may range from about 100 microns to about 500 mm.

The semiconductor structure may have a relatively high aspect ratio, according to some embodiments. The aspect ratio of an article generally refers to the ratio of the length of the article to the width of the article. For example, referring to the exemplary embodiment illustrated in FIG. 1A, the aspect ratio of elongated semiconductor structure 102 corresponds to the ratio of dimensions 118 and 116 (which can be expressed as dimension 118:dimension 116). In some embodiments, the aspect ratio of the semiconductor structure may be at least about 10:1, at least about 20:1, at least about 50:1, at least about 100:1, at least about 200:1 (and/or, in certain embodiments, up to about 500:1, or more). In some embodiments, the aspect ratio of the semiconductor structure may range from about 10:1 to about 500:1.

Figure 3:
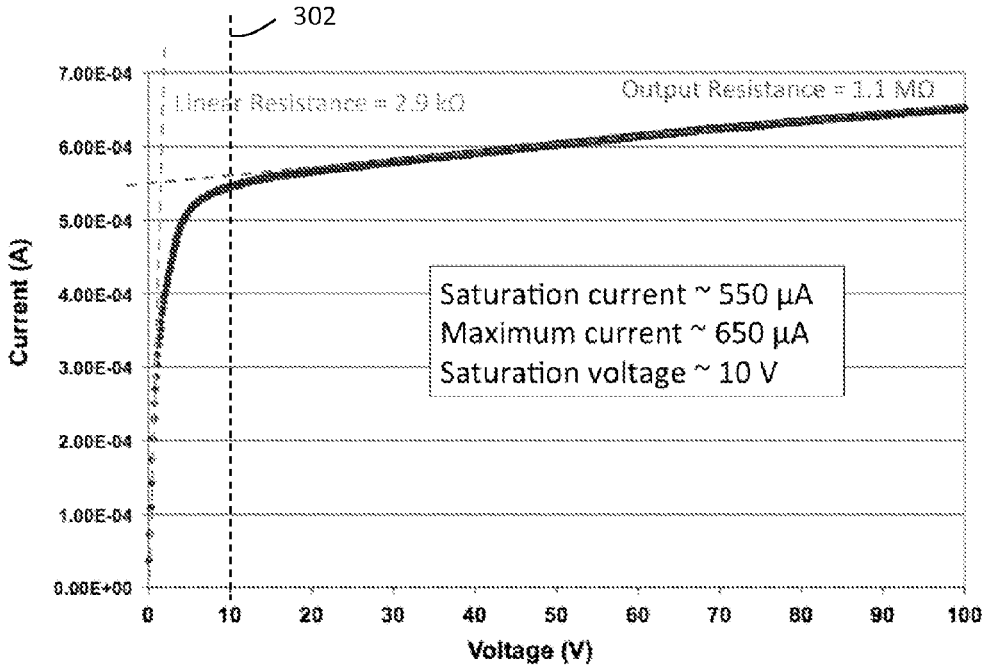
FIG. 3 is, according to one set of embodiments, an exemplary plot of current as a function of voltage for a semiconductor structure.

In some embodiments, the elongated semiconductor structure may be capable of delivering relatively high levels of current to the microplasma cavity. For example, the semiconductor structure may have a relatively high saturation current. Those of ordinary skill in the art are generally familiar with saturation current, which corresponds to the substantially constant amount of current that is delivered by a current-delivery device (e.g., elongated semiconductor structure 102 in FIG. 1A) after the amount of voltage applied to the current-delivery device exceeds a threshold voltage. Explained another way, in certain cases, when the voltage applied across a current-delivery device is increased, the current delivered by the current-delivery device may increase until it reaches a plateau, at which point, further increases in voltage (i.e., beyond the threshold voltage) do not substantially increase the amount of current delivered by the current-delivery device. In such cases, the substantially constant current that is observed at the threshold voltage corresponds to the saturation current. For example, FIG. 3 is an exemplary current-voltage plot (also referred to herein as an I-V plot) showing current as a function of voltage for a semiconductor structure that exhibits a saturation current, according to some embodiments. In FIG. 3, the current flowing through the semiconductor structure increases as the voltage applied to the structure increases until the voltage reaches a certain threshold voltage value, marked with dashed line 302 in FIG. 3. As voltage increases beyond the threshold voltage, the current flowing through the semiconductor structure remains substantially constant. For voltages above the threshold voltage, the semiconductor structure thus exhibits current-source-like behavior. That is, above the threshold voltage, the semiconductor structure delivers a substantially constant current, which is referred to as the saturation current. Without wishing to be bound by a particular theory, current flowing through a semiconductor structure might saturate above a certain voltage at least in part because the velocity of mobile charge carriers (i.e., electrons or holes) within the semiconductor saturates above a certain voltage. That is, above a certain voltage, carrier velocity might not increase with increasing voltage, at least in part because the carriers lose energy through increased interaction with the lattice of atoms. The saturation of carrier velocity may also be related to pinching off of the depletion region and dependence of impedance on voltage.

The saturation current of a particular current-delivery device can be controlled, for example, by selecting and/or altering properties of the material from which the current-delivery device is made. For example, the saturation current of an elongated semiconductor structure may be altered by selecting and/or altering the semiconductor material from which the structure is made, the doping concentration of the semiconductor, and/or the geometry of the elongated semiconductor structure. In some embodiments, the elongated semiconductor structure may have a saturation current of at least about 0.1 mA, at least about 0.5 mA, at least about 1 mA, at least about 5 mA, at least about 10 mA, or at least about 50 mA (and/or, in certain embodiments, up to about 100 mA, or more). In some embodiments, the saturation current of the semiconductor structures may range from about 0.1 mA to about 100 mA. In certain embodiments, the saturation current can be controlled by applying a voltage to a gate electrode, as described in more detail elsewhere.

In some embodiments, the semiconductor structures can be configured such that relatively stable microplasma is produced. In some instances where a microplasma generator is not ballasted, the generated microplasma may experience ionization overheating thermal instability. That is, in some cases, an incremental increase in electron density may result in an increase in the number of collisions, which may increase the temperature of neutral gas within the microplasma. The increase in gas temperature may thereby reduce gas density and increase the electric field. In certain instances, if the electric field is not decreased in some manner, the increase in electric field may cause an increase in electron temperature. Increasing electron temperature may increase the ionization rate, which may cause a further increase in electron density. A positive feedback loop may thus be created, and gas temperature may continue to increase. The presence of a ballasting structure may prevent such thermal instabilities, leading to more stable operation of the microplasma generation device.

In addition, ballasting structures may allow, according to certain embodiments, operation of a microplasma generator in inherently unstable regions of interest. In general, microplasma generators can have three modes of operation: the Townsend mode at low currents, the hollow cathode discharge mode, and the abnormal glow discharge mode at high currents. While the Townsend and abnormal glow modes have I-V characteristics with positive slope, the hollow cathode discharge mode has I-V characteristics with negative slope. Operation in the hollow cathode mode may be unstable without ballasting. The presence of a ballasting structure may allow a microplasma generator to stably operate in any of the three regions of operation.

Figure 4A:
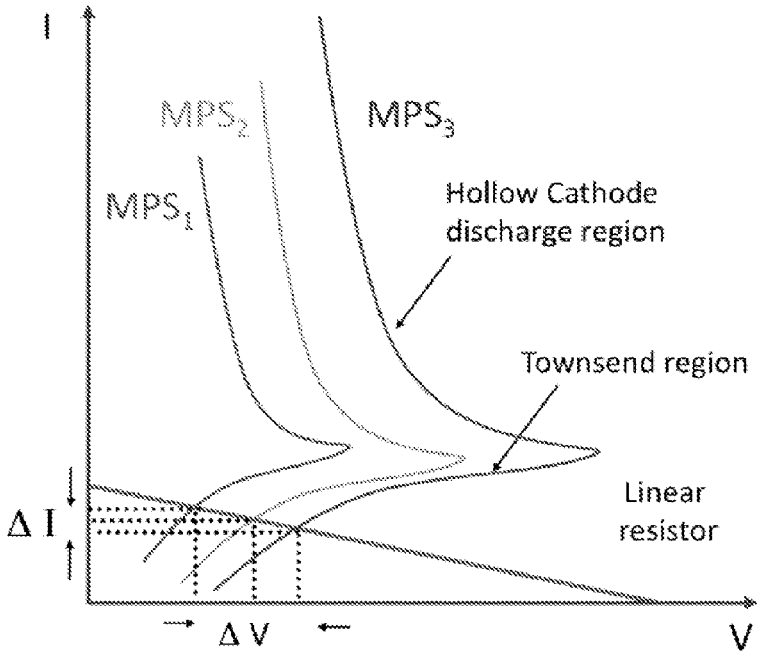
FIG. 4A is an exemplary plot of current as a function of voltage for three microplasma generators ballasted by a linear resistor, according to certain embodiments.
Figure 4B:
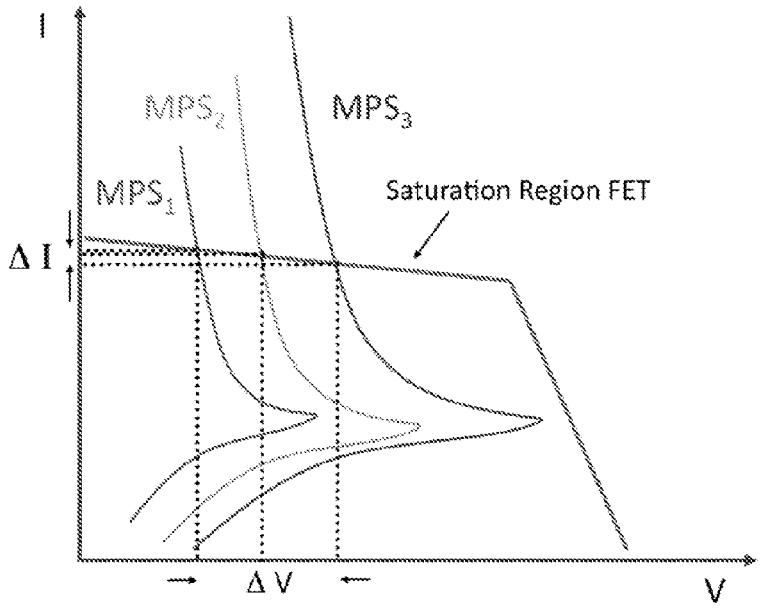
FIG. 4B is an exemplary plot of current as a function of voltage for three microplasma generators ballasted by a semiconductor structure, according to some embodiments.

In some (though not necessarily all) embodiments, the semiconductor structures may provide advantages over alternative ballasting structures for controlling current in the microplasma cavities. For example, the semiconductor structures may be able to simultaneously provide high current and high dynamic resistance, in certain embodiments. Unlike a resistor, which achieves low spatial current spread at the expense of the current level, and a diode in reverse bias, which has low diode reverse bias currents, a device that has current-source-like behavior, such as certain of the elongated semiconductor structures described herein, would be able to provide high current and high dynamic resistance. FIGS. 4A-4B illustrate the difference between ballasting a microplasma cavity with a resistor and a semiconductor structure, according to certain embodiments. FIG. 4A is an exemplary I-V plot of current as a function of voltage for three microplasma generators ballasted by a resistor. While the difference in current between the three generators is small, the level of current delivered is also relatively small. In contrast, FIG. 4B is an exemplary I-V plot of current as a function of voltage for three microplasma generators ballasted by an elongated semiconductor structure. As illustrated in FIG. 4B, due to the I-V characteristics of the semiconductor structure, the ballasted microplasma generators achieved a low current spread at a higher current level than could be achieved by the resistor. In some embodiments, high saturation and high resistance can be achieved in a semiconductor structure by altering doping level, semiconductor material, and device geometry (particularly aspect ratio). A semiconductor structure, according to some embodiments, can be designed such that the microplasma generator operates at any region of operation, including regions with I-V characteristics with negative slope.

Additionally, in some embodiments, the semiconductor structure can provide passive control of current delivered to a microplasma cavity. Passive control generally refers to control that does not require active input (such as, for example, active electronic input, such as the input that might be provided by an electronic controller). For example, in some embodiments, when a voltage above the threshold voltage is applied to a semiconductor structure, it will deliver a substantially constant amount of current to a microplasma cavity without the active input of any device (e.g., without the active input of any electronic device). Passive control, instead of active control, may be desirable in certain cases, due to simplicity and the lack of need to actively monitor and respond to the system response. A passive feedback approach may, in some cases, be cheaper and simpler to manufacture than an active feedback system.

As noted above, in some embodiments, the microplasma generator comprises a microplasma cavity. The microplasma cavity may, in some embodiments, be spatially defined by a structure comprising the elongated semiconductor structure and an electrode. Referring to FIG. 1A, microplasma cavity 114 is spatially defined by semiconductor structure 102 and electrode 108.

Those of ordinary skill in the art generally understand an electrode to be a conductive material configured to transport current. In certain embodiments, the electrode may have a low bulk resistivity. For example, in some embodiments, any of the electrodes described herein have a bulk resistivity of less than about 10 milliohm-cm, less than about 5 milliohm-cm, or less than about 2 milliohm-cm (and/or, in certain embodiments, down to 1 milliohm-cm, or less). In some embodiments, the electrode comprises a metal. The metal comprises, in certain embodiments, Ni, Mo, Pt, and/or W. In some embodiments, the electrode may be substantially planar. The electrode may be substantially annular, substantially circular, substantially rectangular, substantially square, or any other geometry. The electrode may be positioned at any angle in relation to the semiconductor structure. In the exemplary embodiment of FIG. 1A, the plane of electrode 108 is substantially perpendicular to the longitudinal axis 120 of semiconductor structure 102. In other embodiments, the plane of the electrode may be within about 15°, within about 10°, within about 5°, or within about 1° of perpendicular to the longitudinal axis of the semiconductor structure. In other embodiments, the electrode may be at other, non-perpendicular angles relative to the longitudinal axis of the elongated semiconductor structure. The shape and/or orientation of the electrode may, in some embodiments, be altered without affecting the performance of the cavity.

In some embodiments, a gas may be present within the microplasma cavity. In some embodiments, the microplasma may be created by supplying current to a neutral gas such that free electrons and/or ions are created. The gas present within the microplasma cavity comprises, in some embodiments, a noble gas. For example, the gas within the microplasma cavity may comprise helium, neon, argon, krypton, xenon, and/or radon. In some embodiments, the gas within the microplasma cavity may comprise $O_2$ and/or $N_2$. In some embodiments, the gas within the microplasma cavity may comprise a reactive gas. Reactive gases include those that are configured to chemically react with one or more components outside and/or inside the microplasma cavity. Examples of reactive gases suitable for use within the microplasma cavity include, but are not limited to, ozone, carbon monoxide, methane, acetylene, water, hydrogen, ammonia, volatile organic compounds, oxidized nitrogen compounds, sulfur dioxide, $I_2$, $Br_2$, $XeF_2$, $SiH_4$, $CF_4$, $SF_6$, $CHF_3$, HBr, chlorine, and combinations thereof. Such gases may be used, for example, in nanomanufacturing and decontamination applications, or in any application that requires the gases to decompose and create radicals that would not exist outside the pressure and temperature conditions of plasma (e.g., extreme UV generation).

The microplasma cavity may have any shape. For example, in some embodiments, the cavity may be substantially cylindrical, substantially pyramidal, substantially spherical, substantially ellipsoidal, substantially paraboloidal, substantially cubic, substantially rectangular prismatic, or substantially conical. In some embodiments, the characteristic dimensions of the cavity are of the same order of magnitude. For example, for a substantially rectangular prismatic cavity, the aspect ratio of length:width of the cavity may be less than about 10:1, less than about 5:1, or less than about 2:1 (and/or, in certain embodiments, down to about 1:1). In some embodiments, at least one characteristic dimension of the cavity may be of a different order of magnitude as at least one other characteristic dimension of the cavity. For a substantially rectangular prismatic cavity, for example, the aspect ratio of length:width of the cavity may be at least about 20:1, at least about 50:1, at least about 100:1, at least about 200:1, at least about 500:1, or at least about 1000:1 (and/or, in certain embodiments, up to about 10,000:1, or more).

In some embodiments, the microplasma cavity may be relatively small. For example, in some embodiments, the largest cross-sectional dimension of the cavity may be less than about 10 mm, less than about 5 mm, less than about 2 mm, less than about 1 mm, less than about 500 microns, less than about 200 microns, less than about 100 microns, less than about 50 microns, or less than about 20 microns (and/or, in certain embodiments, down to about 10 microns, or less). In some embodiments, the largest cross-sectional dimension of the cavity may be from about 10 microns to about 10 mm. The microplasma can have, in certain embodiments, a maximum cross-sectional dimension that is at least about 5 or at least about 10 times larger than the mean free path of the gas contained within the microplasma.

It may be desirable, in certain embodiments, to generate plasma in relatively small volumes because reducing the size of the cavity can allow breakdown voltage to remain low at relatively high pressures (e.g., pressures up to about 110 kPa, or more). Breakdown voltage generally refers to the voltage at which a gas begins to form microplasmas. Breakdown voltage may be described by the Paschen curve, which relates breakdown voltage to the product of pressure and a gap length (for example, in FIG. 1A, the gap length would be the shortest distance between the second end of semiconductor structure 102 to electrode 108). In some embodiments, the pressure within the microplasma cavity (e.g., during generation of the microplasma) is at least about 0.01 kPa, at least about 0.1 kPa, at least about 1 kPa, at least about 10 kPa, at least about 25 kPa, at least about 50 kPa, or at least about 75 kPa (and/or, in certain embodiments, up to about 110 kPa, or more). In some embodiments, the pressure within the microplasma cavity may be in the range of about 0.01 kPa to about 110 kPa.

In some embodiments, the microplasma generator comprises one or more components comprising a dielectric material. For example, the microplasma cavity can comprise a protective layer. Referring to FIG. 1A, microplasma cavity 114 comprises protective layer 112. In some embodiments, the protective layer comprises a dielectric coating. In some embodiments, the protective layer comprises a semiconductor, for example, a semiconductor with such low doping that it behaves like an insulator (e.g., undoped polysilicon, undoped silicon carbide, and the like). The coating may be on the interior of the cavity. In some embodiments, the coating may be substantially conformal. Those of ordinary skill in the art understand that conformal coatings refer to those in which the coating material physically matches the exterior contour of the surface area of the underlying material, and the coating does not substantially change the morphology of the underlying material. The protective coating may, in certain embodiments, provide protection to the interior of the microplasma cavity from high temperatures, radiation exposure, ion sputtering, and/or electrical breakdown of the microplasma cavity due to deterioration of the surface. In certain embodiments, the coating may comprise undoped silicon carbide, silicon nitride, undoped amorphous silicon, and/or undoped polysilicon.

The microplasma generator may comprise one or more electronically insulating structures. In the exemplary embodiment in FIG. 1A, semiconductor structure 102 is surrounded by electronically insulating structures 110. The insulating structures may, according to some embodiments, allow current to selectively flow through the semiconductor structure to the microplasma cavity. In some embodiments, the one or more insulating structures may comprise a dielectric material. The dielectric material may, in certain cases, comprise silicon carbide (e.g., undoped silicon carbide), silicon nitride, undoped amorphous silicon, and/or undoped polysilicon.

In some embodiments, the microplasma generator comprises a substrate. Referring to FIG. 1A, semiconductor structure 102 and insulating structures 110 are positioned on substrate 104. The substrate may be an electronically conducting substrate, according to some embodiments. That is, the substrate may allow for electronic current to flow through it. In certain cases, the substrate may be in electronic communication with the semiconductor structure. The substrate may additionally be in electronic communication with a voltage source. In some embodiments, the substrate provides a conduit for current to flow from a voltage source to the semiconductor structure. The substrate may, in some cases, comprise a semiconductor material. Non-limiting examples of suitable semiconductors include n-type silicon, p-type silicon, silicon carbide, and gallium arsenide. Other types of semiconductor materials known to those of ordinary skill in the art could also be suitable for use in the substrate. In some cases, the substrate and the semiconductor structure may comprise the same material. In some cases, the substrate and the semiconductor structure may comprise different materials. During fabrication of the microplasma generator, the semiconductor structure may be formed from the substrate, according to some embodiments. In certain cases, the semiconductor structure may be externally attached to the substrate. For example, the structure may be attached to the substrate by an adhesive.

The microplasma generator may comprise, in some embodiments, an optional second electrode. Referring to FIG. 1A, second electrode 106 is positioned at a second end of semiconductor structure 102. Second electrode 106 may have any of the properties (e.g., size, shape, orientation, etc.) of electrode 108 described above. For example, like electrode 108, second electrode 106 may have a low bulk resistivity and may comprise a metal. In some embodiments, the metal may comprise Ni, Mo, Pt, and/or W. Second electrode 106 may be substantially planar and have any geometry. It may also be positioned at any angle relative to semiconductor structure 102. Electrodes 106 and 108 may, in certain embodiments, also have different properties (e.g., size, shape, orientation, material of construction, etc.).

In some embodiments, the microplasma generator is configured to generate a microplasma when a voltage is applied across the elongated semiconductor structure along the longitudinal axis of the structure. In certain cases, the voltage may be a quasi-static voltage. Quasi-static voltage generally refers to voltage that varies slowly (if at all) compared to the time scale of the system. In some embodiments, the voltage may have a frequency of less than about 100 kHz, less than about 10 kHz, less than about 1 kHz, less than about 100 Hz, or less than about 10 Hz (and/or, in certain embodiments, down to about 1 Hz, or less). In certain embodiments, the quasi-static voltage exhibits small-amplitude variations around a baseline voltage value. For example, in some embodiments, the amplitude of the quasi-static voltage may be less than about 50% of the baseline voltage value. In some embodiments, the quasi-static voltage is a direct current voltage. There may be, in some but not necessarily all cases, certain advantages to being able to generate microplasma via application of quasi-static voltage, such as a direct current voltage. For example, a system that uses direct current may use a battery instead of being reliant on a wall plug.

Figure 1B:
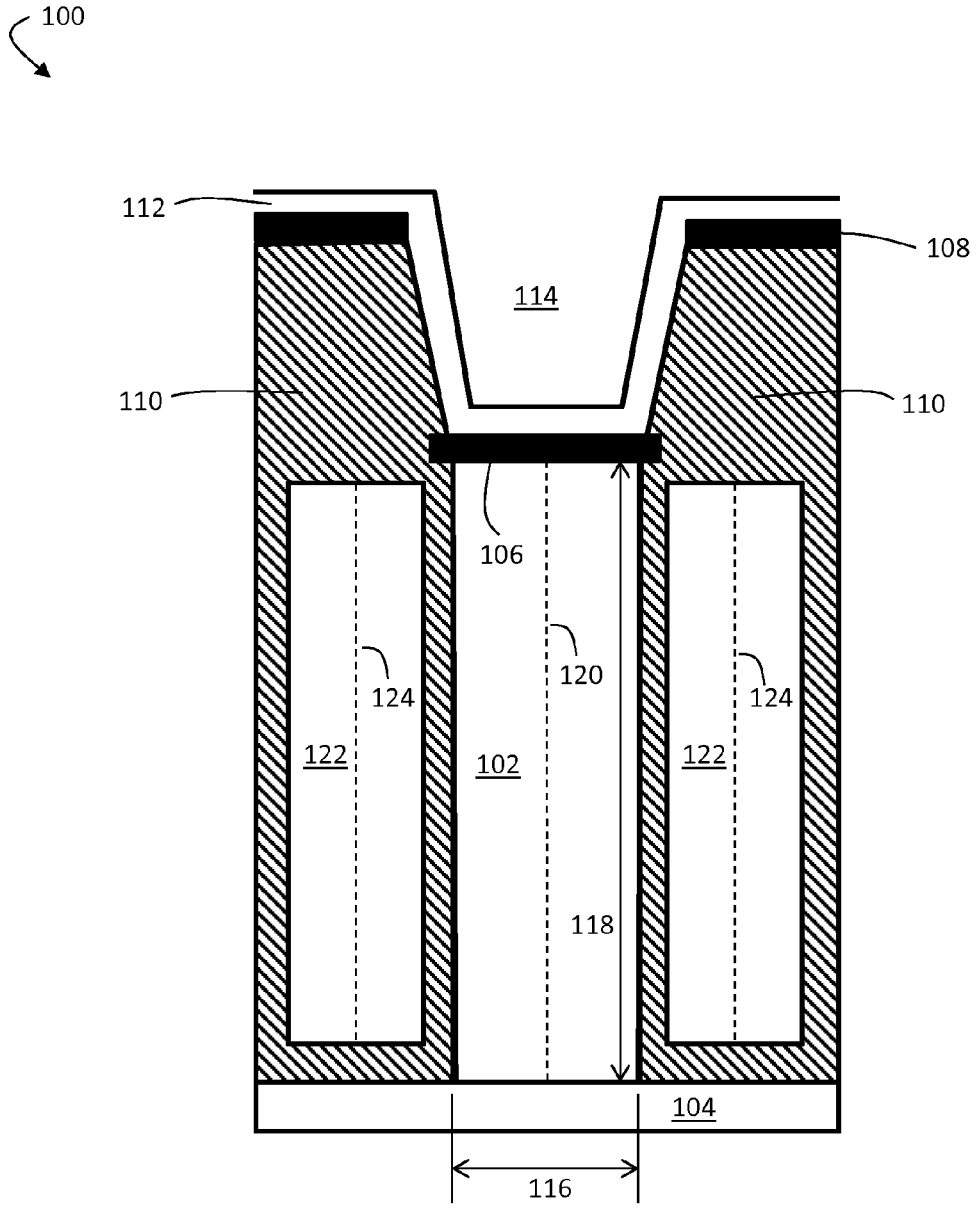

In some embodiments, the microplasma generator may comprise a gate electrode. The gate electrode may be adjacent to the elongated semiconductor structure and outside the microplasma cavity. For example, in FIG. 1B, microplasma generator 100 comprises gate electrodes 122. In some embodiments, the gate electrode is separated from the elongated semiconductor structure by an electrically insulating material. Referring to FIG. 1B, gate electrode 122 is separated from elongated semiconductor structure 102 by insulating structure 110. The gate electrode may have any suitable shape or size. In some embodiments, the gate electrode may be substantially planar. The gate electrode could also be substantially rectangular, substantially square, substantially circular, substantially ellipsoidal, substantially triangular, or the like, according to some embodiments. In certain embodiments, the gate electrode is elongated with a longitudinal axis. In some embodiments, the longitudinal axis of the gate electrode may be substantially parallel to the longitudinal axis of the elongated semiconductor structure. For example, in FIG. 1B, gate electrode 122 has longitudinal axis 124, which is substantially parallel to longitudinal axis 120 of elongated semiconductor structure 102. In some embodiments, the longitudinal axis of the gate electrode is within about 15°, within about 10°, within about 5°, or within about 1° of parallel to the longitudinal axis of the elongated semiconductor structure. The gate electrode can also have a width. In some embodiments, the gate electrode can be at least partially (or, in some cases, substantially completely) surrounded by the insulating structure. In some embodiments, the width of the gate electrode may be less than about 100%, less than about 90%, less than about 80%, less than about 50%, less than about 20%, or less than about 10% (and/or, in some embodiments, down to about 1%, or less) of the width of the insulating structure in which the gate electrode is positioned. In some embodiments, the width of the gate electrode may be less than about 100%, less than about 90%, less than about 80%, less than about 50%, less than about 20%, or less than about 10% (and/or, in some embodiments, down to about 1%, or less) of the width of the elongated semiconductor structure.

The gate electrode can also have any suitable length. In certain embodiments (e.g., the embodiments illustrated in FIGS. 1B and 2C), the gate electrode can have substantially the same length as the elongated semiconductor structure. In other embodiments, the gate electrode can have a length that is shorter or longer than the elongated semiconductor structure. In some embodiments, the length of the gate electrode may be less than about 100%, less than about 90%, less than about 80%, less than about 50%, less than about 20%, or less than about 10% (and/or, in some embodiments, down to about 1%, or less) of the length of the elongated semiconductor structure. In some embodiments, the length of the gate electrode may be at least about 10%, at least about 20%, at least about 50%, at least about 80%, or at least about 90% (and/or, in certain embodiments, up to about 100%, up to about 110%, or up to about 120%, or more) of the length of the elongated semiconductor structure.

In some embodiments, the gate electrode is formed, at least in part, of a metal and/or a semiconductor. Non-limiting examples of suitable metals include aluminum, tantalum, tungsten, tantalum nitride, titanium, titanium nitride, cobalt, nickel, molybdenum, or any combination thereof. In some embodiments, the gate electrode may comprise a silicide (e.g., titanium silicide (TiSi), molybdenum silicide (MoSi), tantalum silicide (TaSi), and/or tungsten silicide (WSi)). In some embodiments, the gate electrode may comprise a semiconductor. For example, the gate electrode may comprise polycrystalline silicon, according to some embodiments. The conductive properties of the semiconductor (such as polycrystalline silicon) may be selected and/or modified, for example, by altering the type and/or level of dopant included within the semiconductor. In some embodiments, the gate electrode may comprise one or more thin layers of a metal and/or a semiconductor.

The gate electrode may be configured such that, when a voltage is applied to the gate electrode, a saturation current of the elongated semiconductor structure is altered (e.g., increased and/or decreased). In certain embodiments, the gate electrode is configured such that, when a voltage is applied to the gate electrode, a saturation current of the elongated semiconductor structure is altered (e.g., increased and/or decreased) by at least about 5%, at least about 10%, at least about 20%, at least about 50%, at least about 100%, at least about 200%, or at least about 500% (and/or, in certain embodiments, up to about 1000%, or more). Without wishing to be bound by any particular theory, it is believed that, when a voltage is applied to the gate electrode, an electric field is generated that alters the depletion accumulation region within the elongated semiconductor structure and thereby alters the saturation current of the elongated semiconductor structure.

In some embodiments, electronic communication between the gate electrode and a voltage source may be provided such that the voltage can be applied to the gate electrode. Electronic contact can be made to the gate electrode, for example, through a via, a trace layer, or any other suitable device known to those of ordinary skill in the art for transporting current. For example, in some embodiments, a via may be formed within substrate 104 and/or insulating structure 110. The via may be lined with an insulating material and at least partially filled with an electronically conductive material such that electrical current can be transported through substrate 104 and insulating structure 110 through the via, without producing an electrical short between gate electrode 122 and substrate 104.

In some embodiments, the gate electrode may be used to provide active control of current delivered to a microplasma cavity. Active control generally refers to control that requires active input (such as, for example, active electronic input, such as the input that might be provided by an electronic controller). For example, in some embodiments, the level of current supplied to the microplasma cavity may be altered by a change in the voltage applied to the gate electrode. The change in voltage may be directed, for example, by an active electronic input. In some cases, active control may be desirable, as it may provide flexibility to alter system response. Unlike a passive feedback system, whose characteristics may be difficult to change following fabrication, an active feedback system, according to some embodiments, may be able to respond as conditions or system requirements change.

Figure 2A:
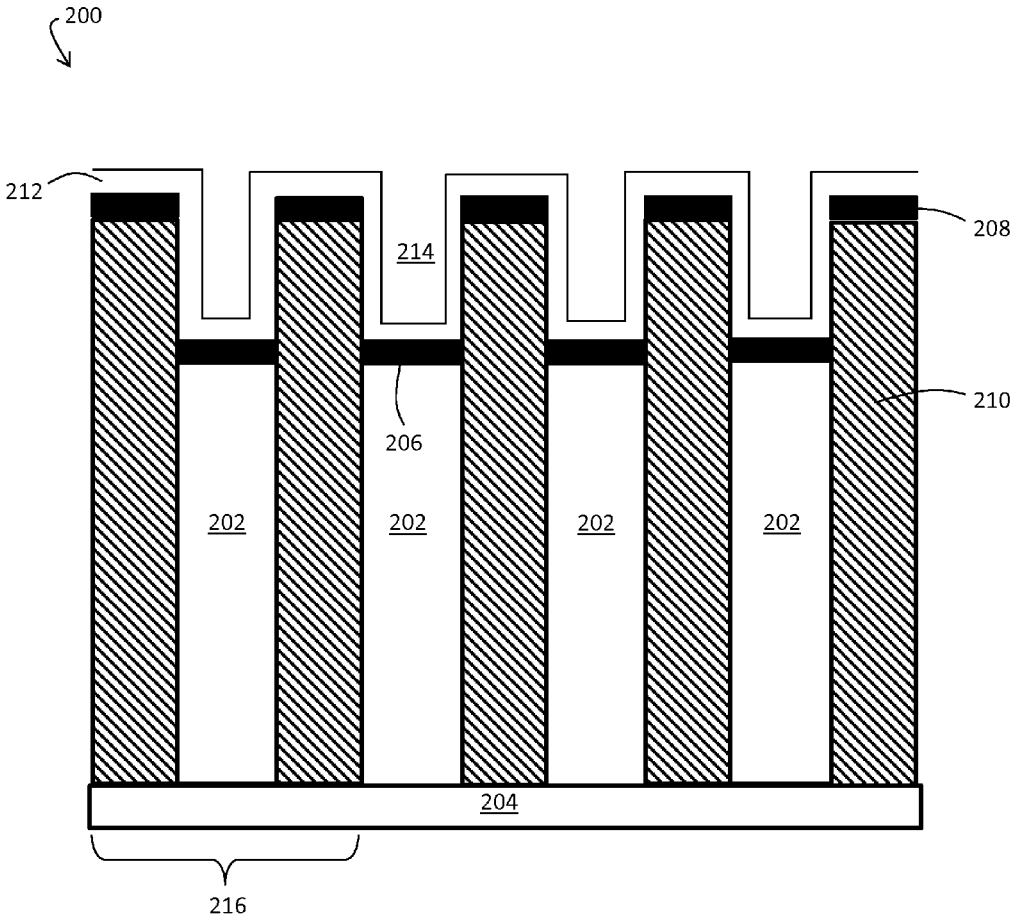
FIGS. 2A and 2C are exemplary cross-sectional, side view schematic illustrations of arrays of microplasma generators, according to certain embodiments.
Figure 2B:
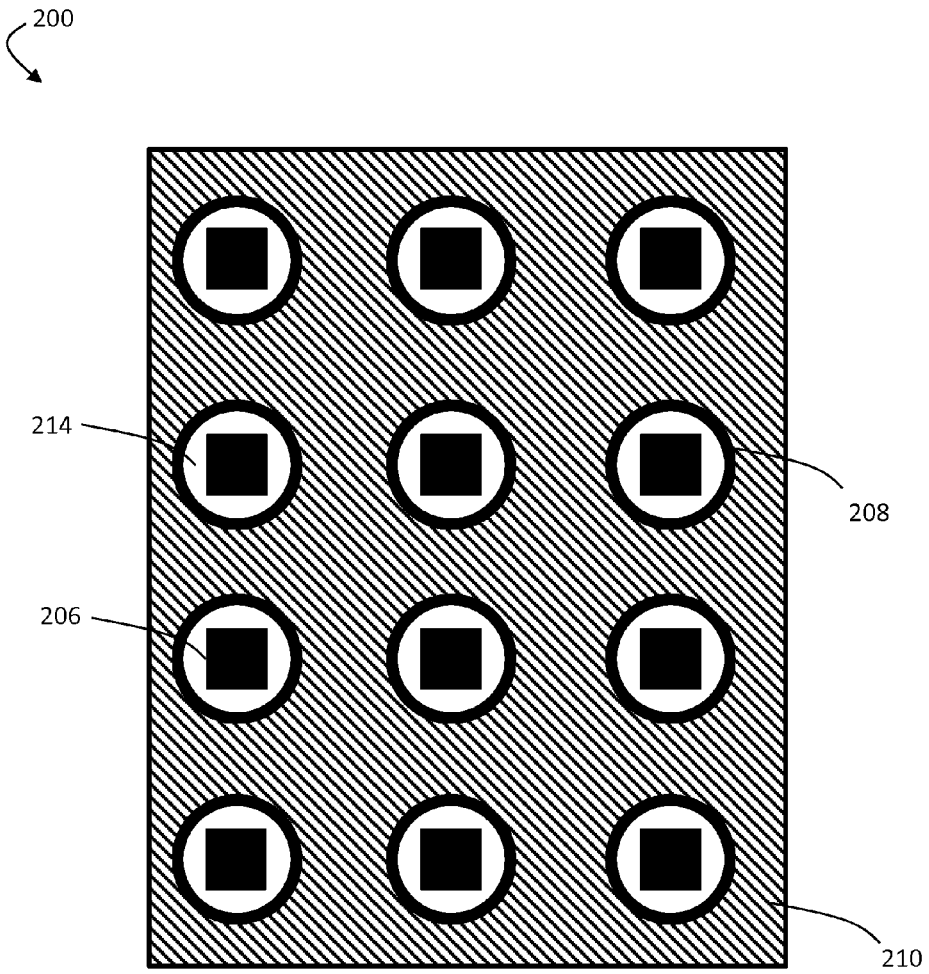
FIG. 2B is an exemplary top-view schematic illustration of an array of microplasma generators, according to one set of embodiments.

Some embodiments relate to an array of microplasma generators. FIGS. 2A-2B are exemplary schematic illustrations of an array 200 of microplasma generators 216. FIG. 2A is a cross-sectional, side-view schematic illustration, and FIG. 2B is a top view schematic illustration. As illustrated in FIG. 2A, array 200 comprises a plurality of elongated semiconductor structures 202. Additionally, array 200 further comprises microplasma cavities 214 defined by structures comprising semiconductor structures 202 and electrodes 208. Array 200 can also comprise protective layer 212. As illustrated in the top-view schematic illustration of FIG. 2B, in one embodiment, microplasma cavities 214 may have a substantially circular cross section. In other embodiments, microplasma cavities 215 may have substantially square, substantially rectangular, substantially elliptical, or substantially triangular cross sections. The cross-sectional shape of the elongated semiconductor structures can also have any suitable shape including, but not limited to, substantially circular, substantially square, substantially rectangular, substantially elliptical, or substantially triangular.

The microplasma generators within the array may have any of the properties described elsewhere herein with respect to individual microplasma generators. For example, the properties (e.g., material of construction, shape, dimension, orientation, performance behavior, physical properties, etc.) of one or more (or all) of the elongated semiconductor structures within the microplasma array may be the same as any of those described elsewhere herein with respect to individual elongated semiconductor structures.

In some embodiments, the array comprises a plurality of elongated semiconductor structures comprising longitudinal axes. In some embodiments, the semiconductor structures are present within the array at a density of at least about 1 structure per $cm^2$, at least about 10 structures per $cm^2$, at least about 20 structures per $cm^2$, at least about 50 structures per $cm^2$, at least about 100 structures per $cm^2$, at least about 500 structures per $cm^2$, at least about 1,000 structures per $cm^2$, at least about 5,000 structures per $cm^2$, at least about 10,000 structures per $cm^2$, at least about 50,000 structures per $cm^2$, at least about 100,000 structures per $cm^2$, or at least about 500,000 structures per $cm^2$ (and/or, in certain embodiments, up to about 1,000,000 structures per $cm^2$, or more). In some embodiments, semiconductor structures are present within the array at a density of about 1 structure per $cm^2$ to about 1,000,000 structures per $cm^2$. In some embodiments, the microplasma cavities are present within the array at a density of at least about 1 cavity per $cm^2$, at least about 10 cavities per $cm^2$, at least about 20 cavities per $cm^2$, at least about 50 cavities per $cm^2$, at least about 100 cavities per $cm^2$, at least about 500 cavities per $cm^2$, at least about 1,000 cavities per $cm^2$, at least about 5,000 cavities per $cm^2$, at least about 10,000 cavities per $cm^2$, at least about 50,000 cavities per $cm^2$, at least about 100,000 cavities per $cm^2$, or at least about 500,000 cavities per $cm^2$ (and/or, in certain embodiments, up to about 1,000,000 cavities per $cm^2$, or more). In some embodiments, the microplasma cavities are present within the array at a density from about 1 cavity per $cm^2$ to about 1,000,000 cavities per $cm^2$. To determine the density of an array of objects (e.g., elongated semiconductor structures, microplasma cavities, etc.), one of ordinary skill in the art would count the number of units present within the array, calculate the geometric surface area occupied by the array, and divide the number of units by the geometric surface area. Those of ordinary skill in the art understand that the geometric surface area refers to the area of the theoretical surface defining the outer boundaries of the array, for example, the area that may be measured by a macroscopic measuring tool (e.g., a ruler), and does not include the internal surface area that might be present within the outer surface of the array (e.g., area defined by the walls of the microplasma cavities).

In some embodiments, a plurality of electronically insulating structures are positioned between the semiconductor structures. Referring to FIG. 2A, insulating structures 210 separate semiconductor structures 202. As noted above, the electronically insulating structures may comprise a dielectric material. The dielectric material may, in some embodiments, comprise silicon oxide, silicon nitride, undoped amorphous silicon, and/or undoped polycrystalline silicon.

In some embodiments, microplasma generators may be arranged in a two-dimensional array. That is to say, the microplasma generators may be arranged along a surface that extends along at least two orthogonal coordinate directions. For example, in certain embodiments, the microplasma generators may be arranged along a surface, which can be curved or substantially planar. In some embodiments, at least a portion of the surface may be tiled. For a cylindrical surface, for example, small tiles may be used to cover the curved surface. The microplasma generators may be arranged randomly or according to a pattern. In some embodiments, the microplasma generators may be ordered in a substantially periodic pattern. The generators may be, for example, hexagonally tiled, triangularly tiled, and/or square tiled.

In some embodiments, when a voltage above a threshold value is applied to the array, microplasma is generated within the microplasma cavities, and the standard deviation in the electronic current levels supplied to each of the microplasma cavities is less than about 100%, less than about 75%, less than about 50%, less than about 25%, or less than about 10% (and/or, in certain embodiments, down to about 1%, or less) of the average of the electronic current levels supplied to the microplasma cavities. Generally, the standard deviation in the electronic current levels supplied to an array of microplasma cavities is measured using a current probe, and current levels are averaged over a period of 10 times the characteristic timescale of the fluctuations. In some embodiments, the electronic current level supplied to at least one of the microplasma cavities is at least about 0.1 mA, at least about 0.5 mA, at least about 1 mA, at least about 5 mA, at least about 10 mA, or at least about 50 mA (and/or, in certain embodiments, up to about 100 mA, or more). In some embodiments, application of a voltage to the microplasma cavities produces currents of at least about 0.1 mA, at least about 0.5 mA, at least about 1 mA, at least about 5 mA, at least about 10 mA, or at least about 50 mA (and/or, in certain embodiments, up to about 100 mA, or more). In some embodiments, application of a voltage to the microplasma cavities produces currents from about 0.1 mA to about 100 mA in the microplasma cavities.

In some cases, ballasting may improve efficiency of an array of microplasma generators. In general, the I-V characteristics of such an array may be affected by the fabrication variability of generators across the array. As noted above, semiconductor structures can provide individual current control to the microplasma cavities. The presence of the semiconductor structures can thereby allow for stable, uniform generation of microplasmas.

In certain embodiments in which an array of microplasma generators is present, the array comprises one or more gate electrodes. In some such embodiments, the array comprises a plurality of gate electrodes adjacent to the elongated semiconductor structures and outside the microplasma cavities of the array. For example, referring to FIG. 2C, array 200 comprises a plurality of gate electrodes 222 positioned adjacent to elongated semiconductor structures 202 and outside microplasma cavities 214. In some embodiments, the gate electrodes are not in contact with the elongated semiconductor structures. The gate electrodes may be separated from the elongated semiconductor structures by an electrically insulating material, according to some embodiments. For example, in FIG. 2C, gate electrodes 222 are separated from elongated semiconductor structures 202 by insulating structure 210. In some embodiments, the gate electrodes may be formed, at least in part, of a metal and/or a semiconductor.

As noted above, in certain embodiments, when a voltage is applied to a gate electrode within the array, the saturation current of an adjacent elongated semiconductor structure can be altered. In some embodiments, the array may be configured such that when a voltage is applied to a first gate electrode, a saturation current of a first elongated semiconductor is altered by at least about 5%, at least about 10%, at least about 20%, at least about 50%, at least about 100%, at least about 200%, or at least about 500% (and/or, in certain embodiments, up to about 1000%, or more). In some embodiments, when a voltage is applied to a second gate electrode, a saturation current of a second elongated semiconductor is altered by at least about 5%, at least about 10%, at least about 20%, at least about 50%, at least about 100%, at least about 200%, or at least about 500% (and/or, in certain embodiments, up to about 1000%, or more).

Figure 2C:
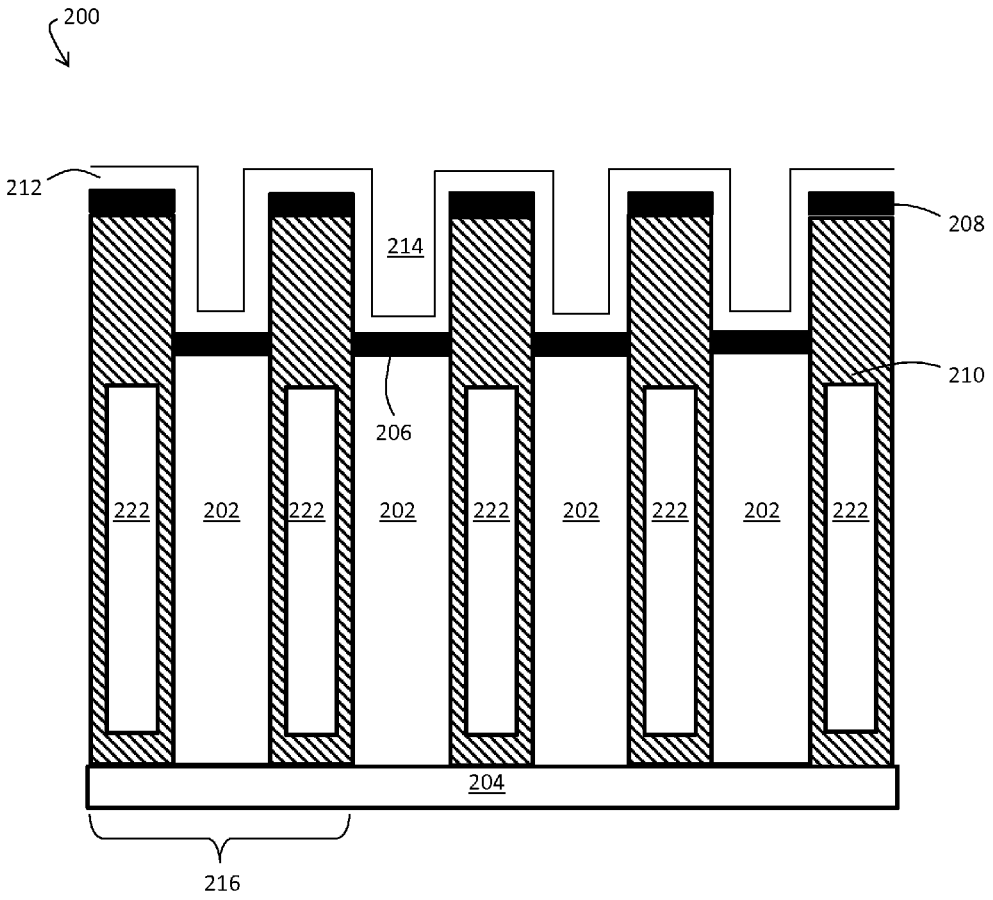

In certain embodiments, multiple gate electrodes 222 can be positioned within the width of the insulating structure (e.g., 110 in FIG. 1B, 210 in FIG. 2C) between adjacent elongated semiconductor structures (e.g., 102 in FIG. 1B, 202 in FIG. 2C). For example, in some embodiments, there can be two gate electrodes 222 within the region between adjacent elongated semiconductor structures. In certain embodiments, each of the gate electrodes can be electrically insulated from each other, which can allow, in some embodiments, for the application of different voltages to the multiple gate electrodes.

In some embodiments, the first voltage (applied to the first gate electrode) and the second voltage (applied to the second gate electrode) may be substantially the same. In some such embodiments, the plurality of gate electrodes may be in electronic communication with a single voltage source, although in other embodiments, multiple voltage sources could be used to supply similar voltages to multiple gate electrodes. In some such embodiments, application of the voltages at similar levels to multiple gates will result in similar changes to the saturation currents of the semiconductor structures associated with those multiple gates. Operation in this manner can allow one to adjust the saturation current of a plurality (and, in some cases, all) of the elongated semiconductor materials within the array simultaneously and/or similarly.

In certain embodiments, the first voltage (applied to the first gate electrode) and the second voltage (applied to the second gate electrode) may be different. In some such embodiments, the first and second gate electrodes may be in electronic communication with first and second voltage sources, respectively. In some embodiments, each gate electrode in the array may be in electronic communication with a different voltage source. In some such embodiments, the voltage applied to a first gate electrode may be different from the voltage applied to at least one, at least two, at least three, or more other gate electrodes. In some cases, the voltage applied to each gate electrode may be different. Operation in this manner can allow one to adjust the saturation current of a plurality of (and, in some cases, all of) the elongated semiconductor materials within the array individually and/or independently. This can allow one to supply different electrical currents to two or more (or, in some cases, at least three, at least four, or more, or all) of the elongated semiconductor structures within the array. It may be desirable, in some cases, to be able to individually control the saturation current of each microplasma cavity to produce an array of microplasmas having one or more desirable properties. For example, a plasma field to control the boundary layer in an airfoil may need to vary spatially and/or in time, since the conditions required to influence the boundary layer at the leading edge may be different from the conditions required downstream and these conditions may vary during flight.

In certain embodiments, the microplasma cavities can be modulated relatively quickly. In some embodiments, modulation of one or more (or all) of the microplasma cavities (e.g., within an array) may occur on the order of about 1 millisecond or less, about 1 microsecond or less, or about 1 nanosecond or less (and/or, in certain embodiments, down to about 0.1 nanoseconds, or less). In some embodiments, modulation of each microplasma cavity may occur on the order of the charge recombination of carriers in the semiconductor of the elongated semiconductor structure.

In some embodiments, the microplasma cavities may be modulated through photoactuation. For example, the backside of an array may be excited by laser pulses (for example, on the order of less than 30 ps) to create current surges in the elongated semiconductor structures. In some cases, the current surges experienced by a first microplasma cavity and a second microplasma cavity may be substantially the same or substantially different.

Certain embodiments relate to methods of generating microplasma. In one embodiment, the method comprises applying a voltage along a longitudinal axis of an elongated semiconductor structure. For example, referring to FIG. 1A, a voltage may be applied along the longitudinal axis 120 of elongated semiconductor structure 102. A voltage is applied along the longitudinal axis of an article when the resulting current produced by the applied voltage (absent any effects from outside voltage sources or fields of electromagnetic radiation) travels along the longitudinal axis of the structure. Referring to FIG. 1A, a voltage can be applied along longitudinal axis 120 of elongated semiconductor structure 102 by applying the voltage (e.g., from a voltage source) across, for example, substrate 104 and electrode 108. The applied voltage may result in an amount of current being delivered to microplasma cavity 114, resulting in generation of a microplasma.

In some embodiments, the method of generating microplasma further comprises applying a voltage to a gate electrode such that a saturation current of the elongated semiconductor structure is altered. In some embodiments, the voltage to the gate electrode alters the saturation current of the elongated semiconductor structure by at least about 5%, at least about 10%, at least about 20%, at least about 50%, at least about 100%, at least about 200%, or at least about 500% (and/or, in certain embodiments, up to about 1000%, or more).

In some embodiments, the method comprises applying a first gate voltage to a first gate electrode such that a saturation current of a first elongated semiconductor structure is altered. The method may further comprise applying a second gate voltage to a second gate electrode such that a saturation current of the second elongated semiconductor structure is altered. In some embodiments, the first gate voltage and second gate voltage are the same. In other embodiments, the first gate voltage and the second gate voltage are different. In some cases, the method may further comprise applying a gate voltage to additional elongated semiconductor structures. As described elsewhere herein, the additional elongated semiconductor structures may be in an array. In some embodiments, the method may comprise applying a different voltage to each gate electrode in the array.

Certain embodiments relate to methods of generating arrays of microplasmas. In one embodiment, the method comprises applying a voltage to at least two microplasma cavities each defined by a structure comprising an elongated semiconductor and an electrode, wherein the standard deviation in the electronic current levels supplied to each of the microplasma cavities is less than about 50% of the average of the electronic current levels supplied to the microplasma cavities. In some embodiments, the at least two microplasma cavities are arranged within an array of microplasma cavities.

The embodiments described herein may be manufactured using standard microfabrication techniques. In some embodiments, various components can be formed from solid materials via micromachining, film deposition processes (such as spin coating, atomic layer deposition, sputtering, thermal evaporation, electroplating, electroless plating, and chemical vapor deposition), laser fabrication, photolithographic techniques, etching methods including wet chemical or plasma processes, and the like. In some embodiments, various components can be made using standard fabrication techniques, including using a saw to define the semiconductor structures.

Referring to exemplary FIG. 2A, for example, the microplasma generators within array 200 can be manufactured using a variety of microfabrication techniques. In some embodiments, substrate 204, which can be a semiconductor substrate, can be etched to produce high aspect ratio semiconductor structures 202 extending from the substrate. The substrate can correspond to any wafer suitable for use in a microfabrication process. For example, the substrate can correspond to a silicon wafer. The high aspect ratio structures can, according to some embodiments, be etched from the substrate using reactive ion etching (e.g., deep reactive ion etching), chemical etching, or any other etching process known in the art. In some embodiments, etching the substrate to produce the high aspect ratio structures can be achieved using one or more etch masks. The high aspect ratio semiconductor structures can subsequently undergo a wet oxidation step to further reduce the width of the structures. The wet oxidation step may also provide dielectric material to fill gaps between the semiconductor structures to form electronically insulating structures. In some embodiments, dielectric material may be deposited in the gaps between the semiconductor structures. For example, dielectric material may be deposited, in some embodiments, by any physical or chemical vapor deposition method known in the art, such as thermal evaporation (including, but not limited to, resistive, inductive, radiation, and electron beam heating), sputtering (including, but not limited to, diode, direct current magnetron, radio frequency, radio frequency magnetron, pulsed, dual magnetron, AC, MF, and reactive), chemical vapor deposition, plasma enhanced chemical vapor deposition, laser enhanced chemical vapor deposition, ion plating, cathodic arc, and jet vapor deposition. In some embodiments, the one or more semiconductor structures can be further etched such that the height of the semiconductor structures is less than the height of the insulating structures, thereby forming one or more microplasma cavities (which can correspond to cavities 214 in FIG. 2A).

In some embodiments, a dielectric substrate is etched to produce one or more high aspect ratio insulating structures extending from the substrate. A semiconductor material can be deposited in gaps between the insulating structures to form semiconductor structures.

In some embodiments, one or more semiconductor structures are etched from a semiconductor substrate and one or more insulating structures are etched from a dielectric substrate. The semiconductor and insulating structures can then be attached to a conductive substrate. For example, the semiconductor structures and insulating structures may be attached using an adhesive.

In some embodiments, one or more electrodes (which can correspond to electrodes 208 in FIG. 2A) may be deposited on the insulating structures. In some such embodiments, the electrodes (e.g., electrodes 208 in FIG. 2A) may at least partially (or completely) surround the one or more microplasma cavities, when the device is viewed along the longitudinal axes of the elongated semiconductor structures (e.g., as illustrated in FIG. 2B). The electrode may be deposited using electroplating, screen printing, any of the material deposition methods listed elsewhere herein, or by any other suitable method. In some embodiments, one or more second electrodes (which can correspond to electrodes 206 in FIG. 2A) may be deposited on the one or more semiconductor structures, and a protective layer can be deposited over the semiconductor structures and microplasma cavities. The one or more second electrodes and the protective layer may be deposited by any of the material deposition methods listed elsewhere herein.

In some embodiments, a microplasma generator comprising a gate electrode may be fabricated using standard microfabrication techniques. According to some embodiments, an insulating structure may be etched to form a cavity, and a metal and/or semiconductor may be deposited into the cavity, thereby forming a gate electrode. For example, referring to FIG. 2C, in some embodiments, when insulating structure 210 is formed (e.g., via a deposition technique such as chemical vapor deposition, or using any other suitable technique), a cavity may be left in insulating structure 210. The cavity within insulating structure 210 can subsequently be filled with an electrode material (using any suitable electrode material deposition technique, including those described elsewhere herein), thereby forming gate electrode 222. Additional insulating material may then be deposited to encapsulate gate electrode 222. In other embodiments, after insulating structure 210 has been formed, insulating structure 210 can be etched (e.g., via deep reactive ion etching) to leave behind a cavity. Electrode material can then be deposited to fill the cavity, forming gate electrode 222. Electrical connections can be made to the gate electrode, for example, by etching a via (e.g., through substrate 204 and/or through insulating structure 210). One may then form an insulating material over the surface of the cavity containing the via and subsequently fill the cavity with via material, thereby producing a via that is electronically insulated from the surrounding environment (e.g., substrate 204).

The embodiments described herein may be used in a wide range of applications. In some embodiments, at least some of the electrons within a microplasma may have relatively high energies. For example, in some cases, at least some of the electrons within a microplasma have energies of at least about 5 eV, at least about 10 eV, or at least about 20 eV (and/or, in certain embodiments, up to 25 eV, or more). In some embodiments, the energy distribution of the electrons of the electrons within the microplasma may be non-Maxwellian. That is, the energy distribution does not follow the Maxwell-Boltzmann distribution. The microplasma, in some embodiments, may have a relatively high electron density. For example, the microplasma may have an electron density of at least about $10^{14}$ $cm^3$, at least about $10^{15}$ $cm^3$, at least about $10^{16}$ $cm^3$, at least about $10^{17}$ $cm^3$, at least about $10^{18}$ $cm^3$ or at least about $10^{19}$ $cm^{-3}$ (and/or, in certain embodiments, an electron density of up to about $10^{20}$ $cm^{-3}$, or more).

In some embodiments, the electrons and/or ions (and/or neutrals, if present) within the microplasma may engage in one or more collisions. The one or more collisions may, in some embodiments, produce one or more excimers. In some embodiments, excimers may be formed in three-body reactions. Those of ordinary skill in the art understand an excimer to refer to an excited molecule with a thermally unstable ground state. In some embodiments, the excimers may comprise noble gas excimers and/or noble gas-halogen excimers. In some embodiments, the excimer may be short-lived. For example, the lifetime of an excimer may be on the order of nanoseconds. In certain instances, as the excimer decays, radiation may be emitted. In some embodiments, the radiation may be in the ultraviolet (e.g., having a wavelength of from about 10 nm to about 400 nm) or extreme ultraviolet (e.g., having a wavelength of from about 10 nm to about 124 nm) spectral range. In certain embodiments, microplasmas in which such excimers are generated can be used as ultraviolet (UV) radiation sources. UV radiation sources may be used, for example, to disinfect surfaces and/or to decompose pollutants, among other uses. Additionally, UV sources may be used in lithography.

In some embodiments, microplasmas comprising energetic electrons may be used for nanoscale synthesis. Energetic electrons may, in some embodiments, interact with gas, liquid, and/or solid precursors to form radical species capable of nucleating nanoparticles. For example, silane gas may be used as a gaseous precursor to produce silicon nanoparticles.

In some embodiments, the microplasma may have a relatively low temperature. The use of microplasmas having relatively low temperatures may be useful in certain instances (although is not required in all embodiments), as it can make them more useful for certain industrial applications. For example, such low-temperature microplasmas may be useful for working with heat-sensitive materials, such as plastics. Additionally, less specialized equipment may be required when working with plasmas at a relatively low temperature. In some embodiments, the microplasma may have a temperature of less than about 1000 K, less than about 900 K, less than about 800 K, less than about 700 K, less than about 600 K, less than about 500 K, less than about 400 K (and/or, in certain embodiments, as low as 300 K, or lower). In some embodiments, the microplasma may have a temperature in the range from about 300 K to about 1000 K.

In some embodiments, the microplasma may have a relatively high pressure. Previously, plasmas commonly had relatively low pressures which could generally only be generated using vacuum systems. In contrast, certain embodiments described herein relate to microplasmas that can be generated closer to atmospheric pressure (or even above atmospheric pressure), which can allow for the use of less complex and/or expensive vacuum equipment and/or the use of no vacuum equipment. In some embodiments, the microplasma may have a pressure of at least about 0.01 kPa, at least about 0.1 kPa, at least about 1 kPa, at least about 10 kPa, or at least about 50 kPa (and/or, in certain embodiments, up to about 110 kPa, or more).

In some embodiments, a distributed microplasma array may be used to control the boundary layer of airplane wings to produce less drag. In some such embodiments, the optimized plasma field varies spatially, since the conditions required to influence the boundary layer at the leading edge are different from the conditions required downstream. The plasma field can also vary in time, for example, to accommodate to a wide range of conditions during flight.

Microplasmas may also be used as energy-efficient, low-cost light sources and in plasma displays where each pixel is illuminated by a microplasma, with UV light from each microplasma pixel used to excite different colored phosphors to produce a full color display.

Microplasmas may also be used in etching and deposition processes, for example, in photolithographic manufacturing processes. It may be desirable to use microplasmas in manufacturing processes, since microplasmas operate at near-atmospheric pressure and therefore do not necessarily need vacuum pumps for operation, which can result in lower manufacturing costs.

As used herein, Group II elements include Be, Mg, Ca, Sr, Ba, and Ra; Group III elements include B, Al, Ga, In, Tl, and Uut; Group IV elements include C, Si, Ge, Sn, Pb, and Fl; Group V elements include N, P, As, Sb, Bi, and Uup; Group VI elements include O, S, Se, Te, Po, and Lv.

The following example is intended to illustrate certain embodiments of the present invention, but does not exemplify the full scope of the invention.

EXAMPLE 1

This example describes the fabrication of a 143×143 array of microplasma generators, with as many as 20,450 steady-operating microplasma generators in 1 square centimeter. The cross section of each semiconductor structure was about 30 micrometers, the pitch between microplasma cavities was 70 micrometers, and the length of each semiconductor structure was 900 micrometers. Each semiconductor structure regulated the current to about 2.5 mA. The microplasma cavities were 20 micrometers tall and 20 micrometers wide.

An array of microplasma generators was microfabricated from a 1,200 micron-thick, 6-inch double side polished n-type silicon (n-Si) wafer with a doping concentration of $1\times10^{14}$ $cm^3$. Initially, a 0.5 micron thick thermal silicon oxide ($SiO_2$) layer was grown on the silicon substrate. This layer was used to protect the silicon structures during processing and also to avoid lateral oxidation in the silicon-silicon nitride interface. Following the thermal oxide growth, low pressure chemical vapor deposition (LPCVD) was used to deposit first a 0.5 micron thick silicon-rich silicon nitride layer and then a 5 micron thick thermal silicon oxide ($SiO_2$) layer that was annealed in nitrogen for 1 hour at 950° C. The silicon nitride layer served as a diffusion barrier for oxygen during subsequent oxidation steps, and the second $SiO_2$ layer was used as a hard mask for etching the silicon structures.

After the deposition of the thin-film stack on the silicon substrate, the substrate was coated with photoresist and patterned using photolithography. Reactive ion etching with low pressure $CHF_3$ and $CF_4$ plasma was used to define the dielectric stack to form a hard mask for the silicon high aspect ratio structure arrays. Deep reactive ion etching with alternating $SF_6$ plasma and polymer-rich plasma was then used to etch the silicon high aspect ratio structure arrays, achieving 900 micrometers of depth using an etch window 40 micrometers wide.

After the silicon structures were etched, a wet oxidation step was used to slightly reduce the silicon structure width, improve the aspect ratio, smooth the surface of the semiconductor structure, and partially fill the gap between the columns with a conformal silicon dioxide layer. Additional silicon dioxide layers were deposited by LPCVD to completely fill the gap between the columns. One alternative approach includes depositing LPCVD polysilicon layers, consuming the polysilicon layers as silicon dioxide by wet oxidation, and then depositing low temperature oxide. Another alternative approach includes spinning on glass dielectric material to fill the high aspect ratio gaps between silicon structures. Also, another approach is to fill in the gaps using LPCVD silicon-rich nitride, which can allow for the formation of a film having a very low stress. Films on the back of the substrate might be deposited to compensate for the stresses induced by the film stack on the front of the substrate. The result of the dielectric deposition was an array of semiconductor structures 900 micrometers long and 30 micrometers wide, fully surrounded by dielectric material, including the tops of the semiconductor structures. The thickness of the dielectric on top of the semiconductor structures was on the order of tens of microns, with specific values depending on the actual technology used to deposit the dielectric.

After the gaps between silicon structures were filled, planarization of the substrate was carried out using a chemical mechanical polishing (CMP) step. The result was an array of semiconductor structures 900 micrometers long, 30 micrometers wide, fully surrounded by dielectric, with a flat top surface. The CMP step was done until the top of the substrate (and the top of the semiconductor structures) was covered by a certain thickness of dielectric, e.g., 20 micrometers. The planarization was conducted to help define features using lithography in subsequent processing steps. The planarization of the substrate may not be necessary to get working devices, but it is included here for completeness. Electrodes were then deposited on the top of the substrate. First, a 0.2 micron layer of n-doped polysilicon was deposited and annealed in nitrogen to form a thin layer of N+ film to improve ohmic contact. A 1-micrometer layer of nickel was then electroplated onto the wafer, and the wafer was patterned and etched to define metal contact regions. The patterning created windows in the electrode film stack that were used to define the microplasma cavities.

After electrode definition, the dielectric layer on top of the semiconductor structures was selectively etched to form the microplasma cavities, with the etch stopping at the dielectric-silicon interface. The result was an array of 20 microns tall by 20 microns wide microplasma cavities, each on top of a semiconductor structure measuring 900 microns tall by 30 microns wide, with an aspect ratio of 30:1. Finally, a 0.5 micron layer of silicon carbide (SiC) was deposited using plasma-enhanced chemical vapor deposition, forming a protective layer inside the cavity. Processing to gain access to the substrate and to the top electrode of the microcavity was conducted using standard techniques such as lithography, etching, via forming, metallization, lift-off, and the like.

Figure 5:
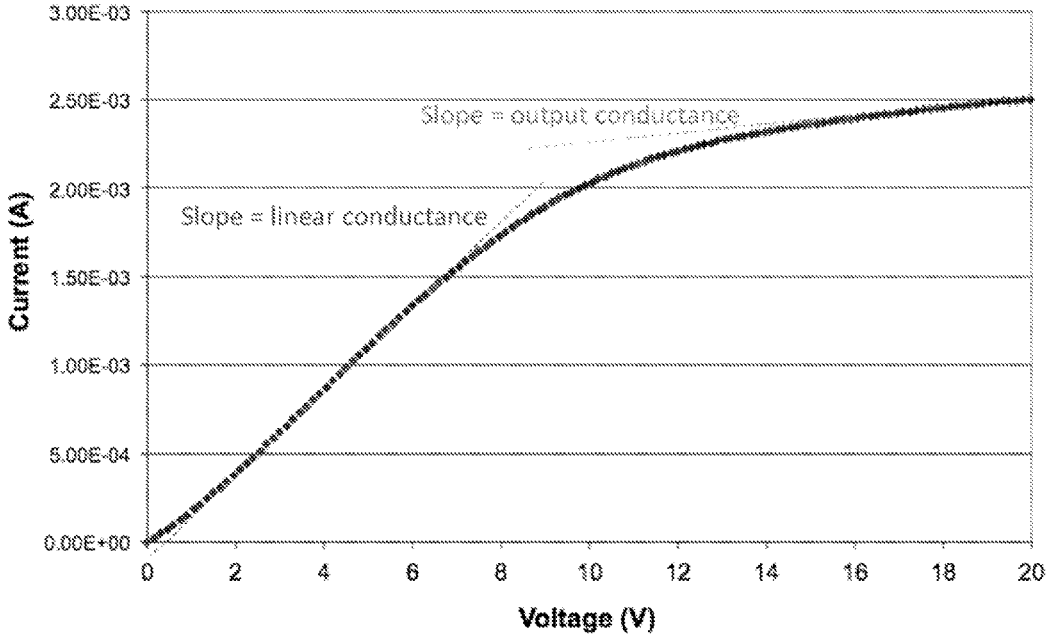
FIG. 5 is, according to one set of embodiments, a plot of current as a function of voltage for an exemplary array of microplasma generators.

The current-voltage characteristic of one of the semiconductor structures is shown in FIG. 5. The linear conductance of the structure was measured to be 170 microSiemens (i.e., 8.9 kiloOhms of resistance, which is the resistance of the structure for bias voltages that are substantially smaller than the saturation voltage of the semiconductor structure). The output conductance of the structure was measured to be 2.45 microSiemens (i.e., 0.41 megaOhms of resistance, which is the resistance of the structure for bias voltages that are larger than the saturation voltage of the semiconductor structure). In this case, the output resistance was more than 69 times the linear resistance, highlighting the advantage of using semiconductor structures to ballast microplasma sources instead of linear resistors. Based on FIG. 5, the saturation voltage of the semiconductor structure was estimated to be about 12 V, and the saturation current was estimated to be about 2.5 mA. The current will slightly increase for bias voltages larger than the saturation voltage, but it will be regulated by the output resistance. For example, if the bias voltage across the semiconductor structure is 100 volts, the current transported by the semiconductor structure is $I=I_{saturation}$+(Voltage across semiconductor structure−saturation voltage)/output resistance (e.g., 2.5 mA+(100−12)/410,000=2.7 mA), a change of less than 8% for a voltage 1,000% larger. The bias voltage across the microplasma cavity and the semiconductor structure will be split between the two components; if the bias voltage across the semiconductor structure is larger than its saturation voltage (e.g., 12 V in the example), the semiconductor structure will limit the current going to the microplasma cavity at about the saturation current (e.g., 2.5 mA in the example). A typical current-voltage characteristic of a microplasma source is given by $I=I_o*(V-V_o)\hat{}0.5$, where $V_o$ is the minimum voltage to ignite the microplasma and Io is the minimum current to sustain the microplasma. Assuming $I_o$=1 mA, $V_o$=50 V, if a total voltage of 150 V is applied across the microplasma source and the semiconductor structure, the current fed to the microplasma cavity is equal to the current supplied by the semiconductor structure (i.e., 0.001*(150−X−50)^0.5=0.0025+(X−12)/410,000), where X is the voltage across the semiconductor structure (i.e., X=92.8 V and I=2.7 mA), and the bias voltage across the microplasma cavity would be 57.2 V. Based on the current-voltage characteristic of the semiconductor structure, it is clear that the method can accommodate a wide variation of operational conditions of the microplasma sources. For example, if the fabrication variation of the microplasma sources results in 10× difference in the operational currents for the same voltage, the semiconductor structure will compensate for these differences and result in less than 10% variation of current across the array (this is a result of the high output resistance of the semiconductor structure).

EXAMPLE 2

This example describes the fabrication of a 143×143 array of microplasma generators, with as many as 20,450 steady-operating microplasma generators in 1 square centimeter. The cross-section of each semiconductor structure was about 30 micrometers; the pitch between microplasma cavities was 70 micrometers; the length of each semiconductor structure was 900 micrometers; and each semiconductor structure regulated the current to about 2.5 mA. The microplasma cavities were 20 micrometers tall and 20 micrometers wide. The array of microplasma generators were fabricated as described above in Example 1. However, after planarization of the substrate, trenches around the semiconductor structures were etched using plasma and lithography; the trenches were filled in with n-poly-silicon, and then the trenches were capped with a dielectric. After the microsplasma electrode was defined and the microcavity etched, the process flow yielded a device similar in cross-section to that shown in FIG. 1B.

Figure 6:
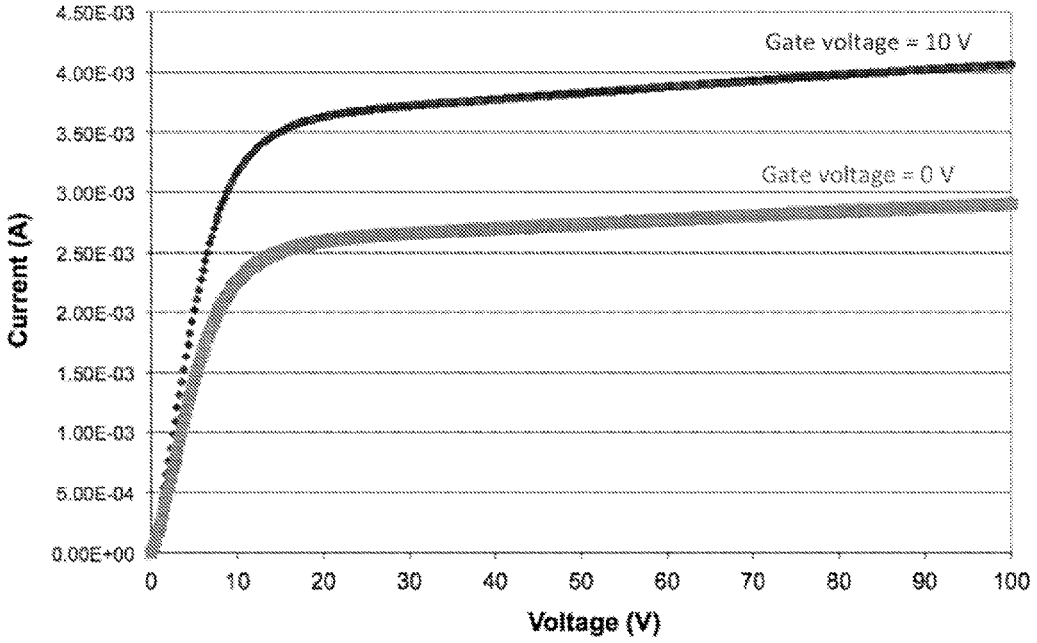
FIG. 6 is a plot of current as a function of voltage for an exemplary array of microplasma generators, according to certain embodiments.

As shown in FIG. 6, the gate electrode can be used to modulate the current supplied by the semiconductor structure. If the gate electrode bias voltage is increased, the current supplied by the semiconductor structure increases, without losing the saturation behavior (high output resistance); if the gate electrode bias voltage is decreased, the current is also decreased and the current limitation behavior of the semiconductor structure is preserved.

A microcavity in series with the semiconductor structure will experience a constant current (and consequently, operation at constant power). The actual current fed by the semiconductor structure to the microplasma cavity can be found by equalizing the equations of the current-voltage characteristics of the two components, similar to what was done in Example 1. In FIG. 6, it is clear that the bias voltage across the semiconductor structure can be substantially larger than its saturation voltage, which allows accommodating for a wide variation in the current-voltage characteristics of the microplasma devices across the array. This array may be used to individually regulate each microplasma source with a semiconductor structure that behaves like a current source (e.g., providing high current level with high output resistance).

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A microplasma generator, comprising:

an elongated semiconductor structure comprising a longitudinal axis, a first end, and a second end; and a microplasma cavity spatially defined by a structure comprising the elongated semiconductor structure and an electrode, wherein:

the microplasma generator is configured to generate a microplasma when a voltage is applied across the elongated semiconductor structure along the longitudinal axis of the structure, and the second end of the elongated semiconductor structure is located between the first end of the elongated semiconductor structure and the microplasma cavity.

2. The microplasma generator of claim 1, wherein the voltage is a quasi-static voltage.

3. The microplasma generator of claim 1, wherein the voltage is a direct current voltage.

4. The microplasma generator of claim 1, comprising a gate electrode adjacent to the elongated semiconductor structure and outside the microplasma cavity.

5. The microplasma generator of claim 4, wherein the gate electrode is separated from the elongated semiconductor structure by an electrically insulating material.

6. The microplasma generator of claim 4, wherein the gate electrode is configured such that, when a voltage is applied to the gate electrode, a saturation current of the elongated semiconductor structure is altered.

7. The microplasma generator of claim 4, wherein the gate electrode is formed, at least in part, of a metal and/or a semiconductor.

8. The microplasma generator of claim 1, wherein the semiconductor structure has a saturation current of at least about 0.1 mA.

9. The microplasma generator of claim 1, wherein the aspect ratio of the semiconductor structure is at least about 10:1.

10. The microplasma generator of claim 1, wherein the semiconductor structure has a width of at least about 10 microns.

11. The microplasma generator of claim 1, wherein the semiconductor structure has a bulk resistivity of at least about 1 milliohm-cm.

12. The microplasma generator of claim 1, comprising a gas within the microplasma cavity.

13. The microplasma generator of claim 1, wherein the largest cross-sectional dimension of the microplasma cavity is from about 10 microns to about 10 mm.

14. The microplasma generator of claim 1, wherein an interior of the microplasma cavity comprises a dielectric coating.

15. The microplasma generator of claim 1, wherein the electrode comprises a metal.

16. The microplasma generator of claim 1, wherein the microplasma generator is configured to generate microplasma at a pressure of at least about 0.01 kPa within the microplasma cavity.

17. An array of microplasma generators, comprising:

a plurality of elongated semiconductor structures comprising longitudinal axes;

a plurality of microplasma cavities spatially defined by structures comprising the elongated semiconductor structures and first electrodes; and a plurality of gate electrodes adjacent to the elongated semiconductor structures and outside the microplasma cavities, wherein the array is configured such that, when a voltage above a threshold value is applied to the array, microplasma is generated within the microplasma cavities, and when a voltage is applied to the gate electrode, a saturation current of the elongated semiconductor structure is altered.

18. The array of claim 17, wherein the semiconductor structures are present within the array at a density of at least about 1 structure per $cm^2$.

19. The array of claim 17, wherein a plurality of electronically insulating structures are positioned between the semiconductor structures.

20. A method of generating microplasma, comprising:

applying a voltage along a longitudinal axis of an elongated semiconductor structure such that microplasma is generated within a microplasma cavity spatially defined by a structure comprising the elongated semiconductor structure and an electrode, wherein:

the elongated semiconductor structure comprises a first end and a second end; and the second end of the elongated semiconductor structure is located between the first end of the elongated semiconductor structure and the microplasma cavity.

21. The method of claim 20, comprising applying a voltage to a gate electrode such that a saturation current of the elongated semiconductor structure is altered.

22. A microplasma generator, comprising:

an elongated semiconductor structure comprising a longitudinal axis;

a microplasma cavity spatially defined by a structure comprising the elongated semiconductor structure and a first electrode; and a second electrode, the second electrode being between the elongated semiconductor structure and the microplasma cavity, wherein the microplasma generator is configured to generate a microplasma when a voltage is applied across the elongated semiconductor structure along the longitudinal axis of the structure.

23. A method of generating microplasma, comprising:

applying a voltage along a longitudinal axis of an elongated semiconductor structure such that microplasma is generated within a microplasma cavity spatially defined by a structure comprising the elongated semiconductor structure and a first electrode, wherein the structure further comprises a second electrode between the elongated semiconductor structure and the microplasma cavity.

* * * * *